US011557228B1

(12) United States Patent
Kraft et al.

(10) Patent No.: US 11,557,228 B1
(45) Date of Patent: Jan. 17, 2023

(54) WRISTBAND AND LABEL FORM

(71) Applicant: Ward-Kraft, Inc., Fort Scott, KS (US)

(72) Inventors: Roger Kraft, Fort Scott, KS (US); Gina Staudinger, Louisburg, KS (US); Phil Quick, Fort Scott, KS (US)

(73) Assignee: Ward-Kraft, Inc., Fort Scott, KS (US)

( * ) Notice: Subject to any disclaimer, the term of this patent is extended or adjusted under 35 U.S.C. 154(b) by 0 days.

(21) Appl. No.: 17/514,620

(22) Filed: Oct. 29, 2021

Related U.S. Application Data

(63) Continuation-in-part of application No. 17/307,622, filed on May 4, 2021, which is a continuation of
(Continued)

(51) Int. Cl.

| | |
|---|---|
| ***G09F 3/00*** | (2006.01) |
| ***G09F 3/10*** | (2006.01) |
| *G09F 3/02* | (2006.01) |

(52) U.S. Cl.
CPC ..... *G09F 3/005* (2013.01); *G09F 3/10* (2013.01); *G09F 2003/0201* (2013.01);
(Continued)

(58) Field of Classification Search
CPC ... G09F 3/02; G09F 3/005; G09F 3/10; G09F 2003/0277; G09F 2003/0219;
(Continued)

(56) References Cited

U.S. PATENT DOCUMENTS

| | | | |
|---|---|---|---|
| 230,455 | A | 7/1880 | Wilcox |
| 919,983 | A | 4/1909 | Walsh |

(Continued)

FOREIGN PATENT DOCUMENTS

| | | | |
|---|---|---|---|
| DE | 1039431 | B | 9/1958 |
| EP | 0996106 | A1 | 4/2000 |

(Continued)

OTHER PUBLICATIONS

Non-Final Office Action, dated Jun. 16, 2022, 6 pages, issued in U.S. Appl. No. 16/426,708.

(Continued)

*Primary Examiner* — Cassandra Davis
(74) *Attorney, Agent, or Firm* — Avek IP, LLC

(57) ABSTRACT

A patient-identification wristband. The wristband comprises a strap. A terminal portion of the wristband has an upper section and a lower lamination section. The upper section comprises a printable ink defining a print area, a first slot inboard the print area and between the print area and the strap, a second slot outboard the print area, and a third slot outboard the second slot. The lower lamination section has a fourth slot below the second slot and a fifth slot outboard the fourth slot. A size of the fourth slot is bigger than a size of the first slot. A length of the upper section is greater than a length of the lower lamination section such that when the lower lamination section is folded over for lamination, the lower lamination section covers only a first part of the print area and leaves a second part of the print area exposed.

19 Claims, 15 Drawing Sheets

Related U.S. Application Data application No. 16/418,723, filed on May 21, 2019, now Pat. No. 10,997,874, which is a continuation-in-part of application No. 15/403,922, filed on Jan. 11, 2017, now Pat. No. 10,297,170, which is a continuation of application No. 15/339,105, filed on Oct. 31, 2016, now Pat. No. 10,249,221.

(60) Provisional application No. 63/107,365, filed on Oct. 29, 2020, provisional application No. 62/257,086, filed on Nov. 18, 2015, provisional application No. 62/256,465, filed on Nov. 17, 2015, provisional application No. 62/247,863, filed on Oct. 29, 2015.

(52) U.S. Cl.
CPC ..... *G09F 2003/023* (2013.01); *G09F 2003/0219* (2013.01); *G09F 2003/0226* (2013.01); *G09F 2003/0277* (2013.01)

(58) Field of Classification Search
CPC ..... G09F 2003/023; G09F 2003/0201; G09F 2003/0226; G09F 3/14
See application file for complete search history.

(56) References Cited

U.S. PATENT DOCUMENTS

| | | | |
|---|---|---|---|
| 922,948 | A | 5/1909 | Portmore |
| 1,039,431 | A | 9/1912 | Moore |
| 1,383,335 | A | 7/1921 | Stanley |
| 1,517,456 | A | 12/1924 | Edward |
| 2,054,227 | A | 9/1936 | Shelby |
| 2,073,280 | A | 3/1937 | Lederer |
| 2,553,676 | A | 5/1951 | Jacob |
| 2,641,074 | A | 6/1953 | Richmond |
| 2,687,978 | A | 8/1954 | Vogt |
| 2,914,166 | A | 11/1959 | Bihler |
| 3,153,869 | A | 10/1964 | Twentier |
| 3,197,899 | A | 8/1965 | Twentier |
| 3,402,808 | A | 9/1968 | Anthony |
| 3,517,802 | A | 6/1970 | Petrie |
| 3,585,743 | A | 6/1971 | Jeffers |
| 3,660,916 | A | 5/1972 | Mcdermott et al. |
| 3,854,229 | A | 12/1974 | Morgan |
| 4,004,362 | A | 1/1977 | Barbieri |
| 4,078,324 | A | 3/1978 | Wiebe |
| 4,138,234 | A | 2/1979 | Kubesa |
| 4,179,833 | A | 12/1979 | Knodel |
| 4,226,036 | A | 10/1980 | Krug |
| 4,233,715 | A | 11/1980 | McDermott |
| 4,314,415 | A | 2/1982 | Woskin |
| 4,318,234 | A | 3/1982 | Charles et al. |
| 4,370,370 | A | 1/1983 | Iwata et al. |
| 4,565,731 | A | 1/1986 | Komatsu et al. |
| 4,612,718 | A | 9/1986 | Golub et al. |
| 4,627,994 | A | 12/1986 | Welsch |
| 4,630,384 | A | 12/1986 | Breen |
| 4,682,431 | A | 7/1987 | Chuk |
| 4,696,843 | A | 9/1987 | Schmidt |
| 4,783,917 | A | 11/1988 | Smith et al. |
| 4,829,604 | A | 5/1989 | Allen et al. |
| 4,854,610 | A | 8/1989 | Kwiatek |
| 4,855,277 | A | 8/1989 | Walter |
| 4,914,843 | A | 4/1990 | Dewoskin |
| 4,941,210 | A | 7/1990 | Konucik |
| 4,950,638 | A | 8/1990 | Yuyama et al. |
| 4,956,931 | A | 9/1990 | Seike et al. |
| D312,654 | S | 12/1990 | Giordano |
| 4,978,144 | A | 12/1990 | Schmidt et al. |
| 4,991,337 | A | 2/1991 | Solon |
| RE33,616 | E | 6/1991 | Welsch |
| 5,026,084 | A | 6/1991 | Pasfield |
| 5,031,382 | A | 7/1991 | Boyle |
| 5,045,426 | A | 9/1991 | Maierson et al. |
| 5,048,870 | A | 9/1991 | Mangini et al. |
| 5,103,583 | A | 4/1992 | VanErmen |
| 5,135,789 | A | 8/1992 | Schmidt |
| 5,222,823 | A | 6/1993 | Conforti et al. |
| 5,227,004 | A | 7/1993 | Belger |
| 5,227,209 | A | 7/1993 | Garland |
| 5,283,969 | A | 2/1994 | Weiss |
| 5,311,689 | A | 5/1994 | Lindsey |
| 5,318,326 | A | 6/1994 | Garrison |
| 5,331,140 | A | 7/1994 | Stephany |
| 5,351,993 | A | 10/1994 | Wright et al. |
| 5,364,133 | A | 11/1994 | Hofer et al. |
| 5,370,420 | A | 12/1994 | Khatib et al. |
| 5,381,617 | A | 1/1995 | Schwartztol et al. |
| 5,383,686 | A | 1/1995 | Laurash |
| 5,395,667 | A | 3/1995 | Ohno et al. |
| 5,401,110 | A | 3/1995 | Neeley |
| 5,418,026 | A | 5/1995 | Dronzek, Jr. et al. |
| 5,421,942 | A | 6/1995 | Hoffmann |
| 5,423,574 | A | 6/1995 | Forte-Pathroff |
| 5,427,416 | A | 6/1995 | Birch |
| 5,448,846 | A | 9/1995 | Peterson et al. |
| 5,457,906 | A | 10/1995 | Mosher, Jr. |
| 5,486,021 | A | 1/1996 | Laurash |
| 5,486,436 | A | 1/1996 | Dale |
| 5,509,693 | A | 4/1996 | Kohls |
| 5,509,694 | A | 4/1996 | Laurash et al. |
| 5,518,787 | A | 5/1996 | Konkol |
| 5,524,934 | A | 6/1996 | Schwan et al. |
| 5,547,227 | A | 8/1996 | Laurash et al. |
| 5,560,657 | A | 10/1996 | Morgan |
| 5,562,789 | A | 10/1996 | Hoffmann |
| 5,581,924 | A | 12/1996 | Peterson |
| 5,586,788 | A | 12/1996 | Laurash |
| 5,595,404 | A | 1/1997 | Skees |
| 5,596,202 | A | 1/1997 | Arakawa |
| 5,598,970 | A | 2/1997 | Mudry et al. |
| 5,601,222 | A | 2/1997 | Haddad |
| 5,601,313 | A | 2/1997 | Konkol et al. |
| 5,630,627 | A | 5/1997 | Stewart |
| 5,637,369 | A | 6/1997 | Stewart |
| 5,648,143 | A | 7/1997 | Mehta et al. |
| 5,653,472 | A | 8/1997 | Huddleston et al. |
| 5,662,976 | A | 9/1997 | Popat et al. |
| 5,670,015 | A | 9/1997 | Finestone et al. |
| 5,687,903 | A | 11/1997 | Akridge et al. |
| 5,721,178 | A | 2/1998 | Lalande |
| D391,991 | S | 3/1998 | Conner |
| 5,752,722 | A | 5/1998 | Moore et al. |
| 5,765,885 | A | 6/1998 | Netto |
| 5,785,354 | A | 7/1998 | Haas |
| 5,837,337 | A | 11/1998 | Schnitzer |
| 5,837,341 | A | 11/1998 | Johnstone |
| 5,840,143 | A | 11/1998 | Swanson |
| 5,842,722 | A | 12/1998 | Carlson |
| 5,877,742 | A | 3/1999 | Klink |
| 5,933,993 | A | 8/1999 | Riley |
| 5,984,363 | A | 11/1999 | Dotson et al. |
| 6,000,160 | A | 12/1999 | Riley |
| 6,006,460 | A | 12/1999 | Blackmer |
| 6,016,618 | A | 1/2000 | Attia et al. |
| D423,044 | S | 4/2000 | Burke et al. |
| 6,053,535 | A | 4/2000 | Washburn et al. |
| 6,055,756 | A | 5/2000 | Aoki |
| 6,058,639 | A | 5/2000 | Tinklenberg et al. |
| 6,067,739 | A | 5/2000 | Riley |
| 6,071,585 | A | 6/2000 | Roth |
| 6,092,321 | A | 7/2000 | Cheng |
| 6,108,876 | A | 8/2000 | Hubbert |
| 6,155,476 | A | 12/2000 | Fabel |
| 6,155,603 | A | 12/2000 | Fox |
| 6,159,570 | A | 12/2000 | Ulrich et al. |
| 6,199,730 | B1 | 3/2001 | Chisolm |
| D448,404 | S | 9/2001 | Hamilton et al. |
| 6,303,539 | B1 | 10/2001 | Tony |
| 6,331,018 | B1 | 12/2001 | Roth et al. |
| 6,343,819 | B1 | 2/2002 | Shiozaki |
| 6,361,078 | B1 | 3/2002 | Chess |
| 6,364,366 | B1 | 4/2002 | Schwartz |

(56) References Cited

U.S. PATENT DOCUMENTS

| | | | | |
|---|---|---|---|---|
| 6,409,871 | B1 | 6/2002 | Washburn et al. | |
| 6,438,881 | B1 | 8/2002 | Riley | |
| 6,510,634 | B1 | 1/2003 | Riley | |
| 6,517,921 | B2 | 2/2003 | Ulrich et al. | |
| D473,264 | S | 4/2003 | Sanford et al. | |
| 6,611,962 | B2 | 9/2003 | Redwood et al. | |
| 6,641,048 | B1 | 11/2003 | Schintz et al. | |
| 6,685,228 | B2 | 2/2004 | Riley | |
| 6,748,687 | B2 | 6/2004 | Riley | |
| 6,782,648 | B1 | 8/2004 | Mosher, Jr. | |
| 6,807,680 | B2 | 10/2004 | Sloot | |
| 6,836,215 | B1 | 12/2004 | Laurash et al. | |
| 6,844,041 | B2 | 1/2005 | Squier et al. | |
| D503,197 | S | 3/2005 | Stewart et al. | |
| 6,863,311 | B2 | 3/2005 | Riley | |
| 6,971,200 | B2 | 12/2005 | Paul et al. | |
| 6,981,948 | B2 | 1/2006 | Pellegrino et al. | |
| 7,017,293 | B2 | 3/2006 | Riley | |
| 7,017,294 | B2 | 3/2006 | Riley et al. | |
| D521,565 | S | 5/2006 | Stewart et al. | |
| 7,047,682 | B2 | 5/2006 | Riley | |
| 7,197,842 | B2 | 4/2007 | Ali | |
| 7,222,448 | B2 | 5/2007 | Riley | |
| 7,240,446 | B2 | 7/2007 | Bekker | |
| 7,286,055 | B2 | 10/2007 | Girvin et al. | |
| 7,325,347 | B2 | 2/2008 | Riley | |
| 7,386,949 | B2 | 6/2008 | Riley | |
| 7,454,854 | B2 | 11/2008 | Riley et al. | |
| 7,461,473 | B2 | 12/2008 | Riley | |
| 7,520,077 | B2 | 4/2009 | Riley | |
| 7,523,576 | B1 | 4/2009 | Petty | |
| 7,654,024 | B2 | 2/2010 | Riley | |
| 7,658,026 | B2 | 2/2010 | Jain et al. | |
| 7,658,027 | B2 | 2/2010 | Jain et al. | |
| D611,984 | S | 3/2010 | Ali et al. | |
| 7,763,344 | B2 | 7/2010 | Riley et al. | |
| 7,779,569 | B2 | 8/2010 | Riley et al. | |
| 7,779,570 | B2 | 8/2010 | Riley | |
| 7,784,209 | B2 | 8/2010 | Greer | |
| 7,784,210 | B2 * | 8/2010 | Riley | G09F 3/005 40/633 |
| 7,818,908 | B2 | 10/2010 | Greer | |
| 7,823,310 | B2 | 11/2010 | Jain et al. | |
| 7,877,915 | B2 | 2/2011 | Jain et al. | |
| 7,883,018 | B2 | 2/2011 | Riley et al. | |
| 7,918,045 | B2 | 4/2011 | Riley | |
| D640,738 | S | 6/2011 | Jain et al. | |
| 7,967,340 | B2 | 6/2011 | Hofer et al. | |
| 8,006,422 | B2 | 8/2011 | Riley | |
| 8,011,125 | B2 | 9/2011 | Riley et al. | |
| 8,042,293 | B1 | 10/2011 | Bennett et al. | |
| 8,074,389 | B2 | 12/2011 | Greer et al. | |
| 8,099,888 | B2 | 1/2012 | Riley | |
| 8,109,021 | B2 | 2/2012 | Jain et al. | |
| 8,424,115 | B2 * | 4/2013 | Greer | A44C 5/0053 2/170 |
| 8,776,417 | B2 | 7/2014 | Jain et al. | |
| 8,844,972 | B2 | 9/2014 | Riley et al. | |
| 8,904,686 | B2 | 12/2014 | Greer | |
| 9,114,187 | B2 | 8/2015 | Hofer et al. | |
| 10,207,020 | B2 | 2/2019 | Hofer et al. | |
| 10,249,221 | B2 | 4/2019 | Davis et al. | |
| 10,997,874 | B1 | 5/2021 | Kraft et al. | |
| 11,232,719 | B1 | 1/2022 | Kraft et al. | |
| 11,238,759 | B1 | 2/2022 | Staudinger et al. | |
| 2002/0152928 | A1 | 10/2002 | Lawandy et al. | |
| 2002/0176973 | A1 | 11/2002 | Keiser | |
| 2003/0001381 | A1 | 1/2003 | Riley | |
| 2003/0003249 | A1 | 1/2003 | Benim et al. | |
| 2003/0011190 | A1 | 1/2003 | Ryan | |
| 2004/0060216 | A1 | 4/2004 | Riley | |
| 2004/0068906 | A1 | 4/2004 | Riley et al. | |
| 2004/0128892 | A1 | 7/2004 | Paul et al. | |
| 2004/0148836 | A1 | 8/2004 | Riley | |
| 2004/0244251 | A1 | 12/2004 | Riley | |
| 2005/0091896 | A1 | 5/2005 | Kotik et al. | |
| 2005/0108912 | A1 | 5/2005 | Bekker | |
| 2005/0279001 | A1 | 12/2005 | Riley | |
| 2005/0281989 | A1 | 12/2005 | Finger | |
| 2006/0113788 | A1 | 6/2006 | Riley | |
| 2006/0230661 | A1 | 10/2006 | Bekker | |
| 2006/0236578 | A1 | 10/2006 | Saint et al. | |
| 2006/0242875 | A1 | 11/2006 | Wilson et al. | |
| 2006/0261958 | A1 | 11/2006 | Klein et al. | |
| 2007/0089342 | A1 | 4/2007 | Jain et al. | |
| 2007/0120358 | A1 | 5/2007 | Waggoner et al. | |
| 2007/0243361 | A1 | 10/2007 | Riley et al. | |
| 2007/0257113 | A1 | 11/2007 | Davis et al. | |
| 2008/0098636 | A1 | 5/2008 | Greer | |
| 2008/0236011 | A1 | 10/2008 | Bekker | |
| 2009/0031602 | A1 | 2/2009 | Riley | |
| 2009/0094872 | A1 | 4/2009 | All et al. | |
| 2009/0094873 | A1 | 4/2009 | Riley | |
| 2009/0193701 | A1 | 8/2009 | Greer | |
| 2009/0277061 | A1 | 11/2009 | Jain et al. | |
| 2009/0282717 | A1 | 11/2009 | Jain et al. | |
| 2010/0071241 | A1 | 3/2010 | Jain et al. | |
| 2010/0253060 | A1 | 10/2010 | Riley et al. | |
| 2010/0281724 | A1 | 11/2010 | Greer et al. | |
| 2011/0042933 | A1 | 2/2011 | Landsman et al. | |
| 2012/0210620 | A1 | 8/2012 | Jain et al. | |
| 2013/0056974 | A1 * | 3/2013 | Jain | G09F 3/005 283/99 |
| 2016/0335928 | A1 | 11/2016 | Lux | |

FOREIGN PATENT DOCUMENTS

| | | | |
|---|---|---|---|
| EP | 1974603 | A2 | 10/2008 |
| EP | 2806594 | A1 | 11/2014 |
| FR | 960859 | A | 4/1950 |
| GB | 561777 | A | 6/1944 |
| GB | 2045718 | A | 11/1980 |
| GB | 2160492 | A | 12/1985 |
| GB | 2228915 | A | 9/1990 |
| JP | H08190350 | A | 7/1996 |
| JP | H08299035 | A | 11/1996 |
| JP | 3032299 | U | 12/1996 |
| JP | H10207374 | A | 8/1998 |
| JP | H1115383 | A | 1/1999 |
| JP | 2001316921 | A | 11/2001 |
| JP | 2002117190 | A | 4/2002 |
| JP | 2002351321 | A | 12/2002 |
| JP | 2003066849 | A | 3/2003 |
| JP | 2003157010 | A | 5/2003 |
| JP | 2003164307 | A | 6/2003 |
| JP | 2006039209 | A | 2/2006 |
| WO | 9612618 | A1 | 5/1996 |
| WO | 9823081 | A1 | 5/1998 |
| WO | 9918817 | A1 | 4/1999 |
| WO | 0239412 | A2 | 5/2002 |
| WO | 03003331 | A2 | 1/2003 |
| WO | 2004028826 | A2 | 4/2004 |
| WO | 2005064574 | A1 | 7/2005 |
| WO | 2006007356 | A1 | 1/2006 |
| WO | 2007021375 | A2 | 2/2007 |
| WO | 2007133906 | A2 | 11/2007 |
| WO | 2008079952 | A2 | 7/2008 |
| WO | 2009099787 | A1 | 8/2009 |
| WO | 2009137195 | A1 | 11/2009 |
| WO | 2010129131 | A1 | 11/2010 |

OTHER PUBLICATIONS

Final Office Action, dated Jul. 8, 2021, 9 pages, issued in U.S. Appl. No. 17/013,065.

Non-Final Office Action, dated Dec. 29, 2017, 15 pages, issued in U.S. Appl. No. 15/339,105.

Non-Final Office Action, dated Jan. 6, 2021, 8 pages, issued in U.S. Appl. No. 17/013,065.

Non-Final Office Action, dated Oct. 30, 2017, 14 pages, issued in U.S. Appl. No. 15/403,922.

Notice of Allowance, dated Jan. 11, 2021, 11 pages, issued in U.S. Appl. No. 16/418,723.

(56) References Cited

OTHER PUBLICATIONS

Notice of Allowance, dated Oct. 5, 2021, issued in U.S. Appl. No. 17/090,883.
Notice of Allowance, dated Sep. 29, 2021, issued in U.S. Appl. No. 17/013,065.
Non-Final Office Action, dated Nov. 25, 2022, 8 pages, issued in U.S. Appl. No. 17/659,140.
Non-Final Office Action, dated Oct. 6, 2022, 16 pages, issued in U.S. Appl. No. 17/588,405.
Notice of Allowance, dated Oct. 19, 2022, 8 pages, issued in U.S. Appl. No. 16/426,708.

* cited by examiner

WRISTBAND AND LABEL FORM

CROSS REFERENCE TO RELATED APPLICATIONS

This application claims priority to U.S. Provisional Patent Application, No. 63/107,365, filed Oct. 29, 2020. This application is also a continuation-in-part of U.S. patent application Ser. No. 17/307,622, filed May 4, 2021, which is a continuation of U.S. patent application Ser. No. 16/418,723, filed May 21, 2019, which will issue as U.S. Pat. No. 10,997,874, which is a continuation-in-part of, and claims priority to, U.S. patent application Ser. No. 15/403,922, filed Jan. 11, 2017, which granted as U.S. Pat. No. 10,297,170, and which is a continuation of, and claims priority to, U.S. patent application Ser. No. 15/339,105, filed Oct. 31, 2016, which granted as U.S. Pat. No. 10,249,221. The '105 application claims priority to U.S. Provisional Application No. 62/247,863, filed on Oct. 29, 2015, U.S. Provisional Application No. 62/256,465, filed on Nov. 17, 2015, and U.S. Provisional Patent Application No. 62/257,086, filed on Nov. 18, 2015. The disclosures of each of these applications are incorporated by reference in their entireties herein.

FIELD OF THE DISCLOSURE

The disclosure relates generally to the field of wristbands. More specifically, the disclosure relates to the field of patient identification wristbands.

SUMMARY

In an embodiment, a patient-identification wristband comprises a strap. A terminal portion of the wristband has an upper section and a lower lamination section. The upper section comprises a printable ink defining a print area, a first slot inboard the print area and between the print area and the strap, a second slot outboard the print area, and a third slot outboard the second slot. The lower lamination section has a fourth slot below the second slot and a fifth slot outboard the fourth slot. A size of the fourth slot is bigger than a size of the first slot. A length of the upper section is greater than a length of the lower lamination section such that when the lower lamination section is folded over for lamination, the lower lamination section covers only a first part of the print area and leaves a second part of the print area exposed.

In another embodiment, a patient-identification wristband comprises a solitary strap and a terminal portion. The terminal portion has an upper section and a lower lamination section. The upper section comprises a printable ink defining a print area, a first slot outboard the print area, and a second slot outboard the first slot. The lower lamination section has a third slot below the first slot and a fourth slot outboard the third slot. A size of the third slot is bigger than a size of the first slot, the second slot, and the fourth slot. A length of the upper section is greater than a length of the lower lamination section such that when the lower lamination section is folded over for lamination, the lower lamination section covers only a first part of the print area and leaves a second part of the print area exposed.

In yet another embodiment, a patient-identification wristband comprises a solitary strap and a terminal portion. The terminal portion has an upper section and a lower lamination section. The upper section comprises a printable ink defining a print area, a first slot inboard the print area and between the print area and the strap, a second slot outboard the print area, and a third slot outboard the second slot. The lower lamination section has a fourth slot below the second slot and a fifth slot outboard the fourth slot. A size of the fourth slot is bigger than a size of the first slot, the second slot, the third slot, and the fifth slot. A length of the upper section is greater than a length of the lower lamination section such that when the lower lamination section is folded over for lamination, the lower lamination section covers only a first part of the print area and leaves a second part of the print area exposed.

BRIEF DESCRIPTION OF THE DRAWINGS

Illustrative embodiments of the present disclosure are described in detail below with reference to the figures.

DETAILED DESCRIPTION

The following describes some non-limiting embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure.

Many wristband designs require multiple steps in order to remove the wristband from its liner and subsequently affix it to the wearer. For example, the user may be required to remove the liner in order to expose adhesive. Other wristbands may be configured to include two layers of material, fastened together with adhesive. The wristband is thus thicker and heavier. Still further designs include a paper layer which is not water resistant that tends to get torn and tattered. According to these designs, a wristband portion is permanently adhered to a paper backing sheet which is die cut in a form, to form a two-layer wristband.

One embodiment of the present invention, described in detail herein, provides for a wristband which may be removed from a form via one generally continuous motion. The wristband may have adhesive on one end only, or on both ends. Further, the wristband may be configured to include only a single layer of a light, synthetic (or other similar) material, thus making the wristband approximately half of the thickness of traditional wristbands currently on the market. Finally, the synthetic material may be water and tear resistant such that the wristband will not tear when removed from the backing sheet prior to affixing the wristband to the person. In one embodiment, the wristband may be configured to be removed from a form without leaving a hole in the form, thus leaving the backing sheet intact such that the form may be passed through a printer multiple times.

Figure 1:
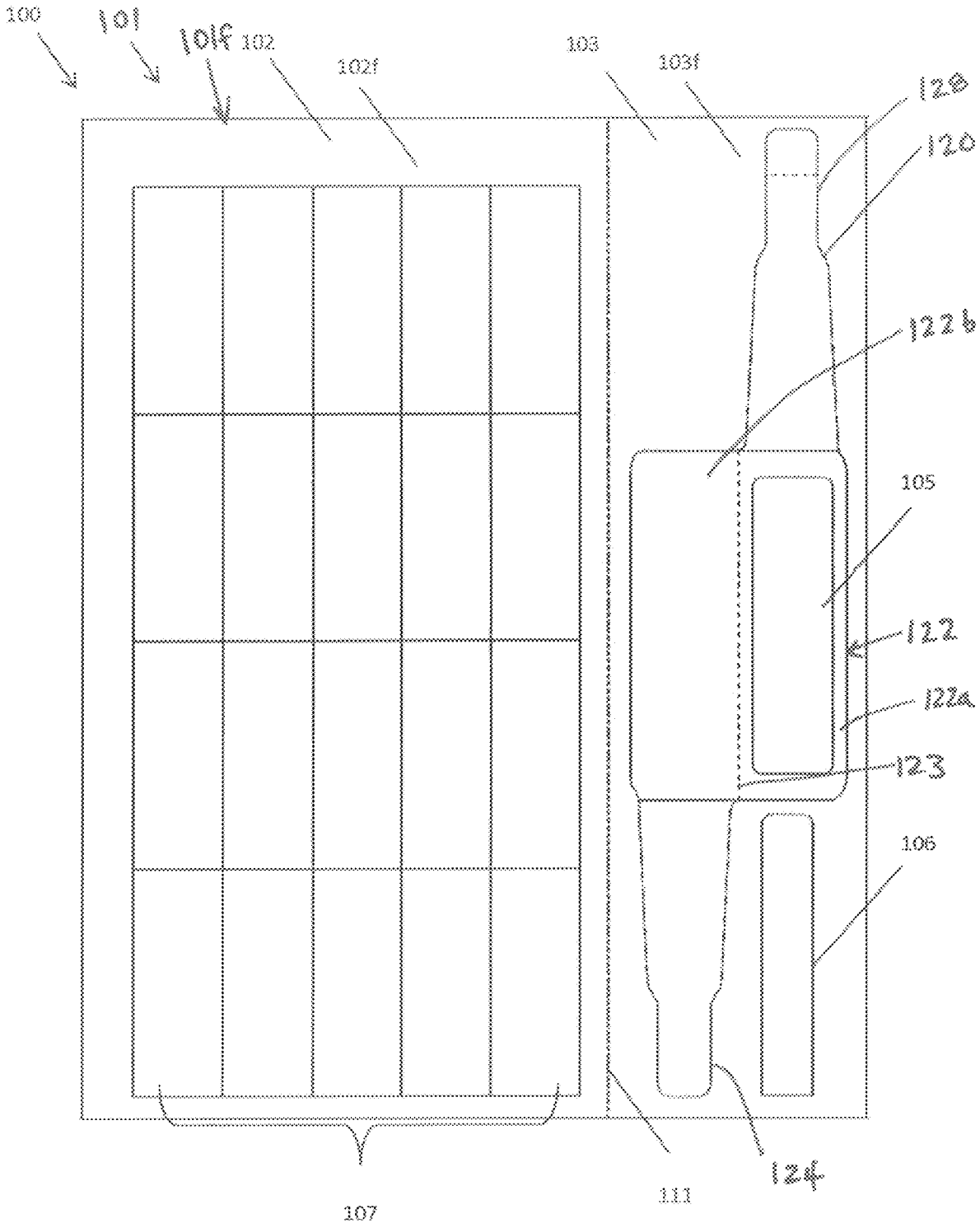
FIG. 1 is a front side view of a combination wristband and label form according to one embodiment of the invention.
Figure 3:
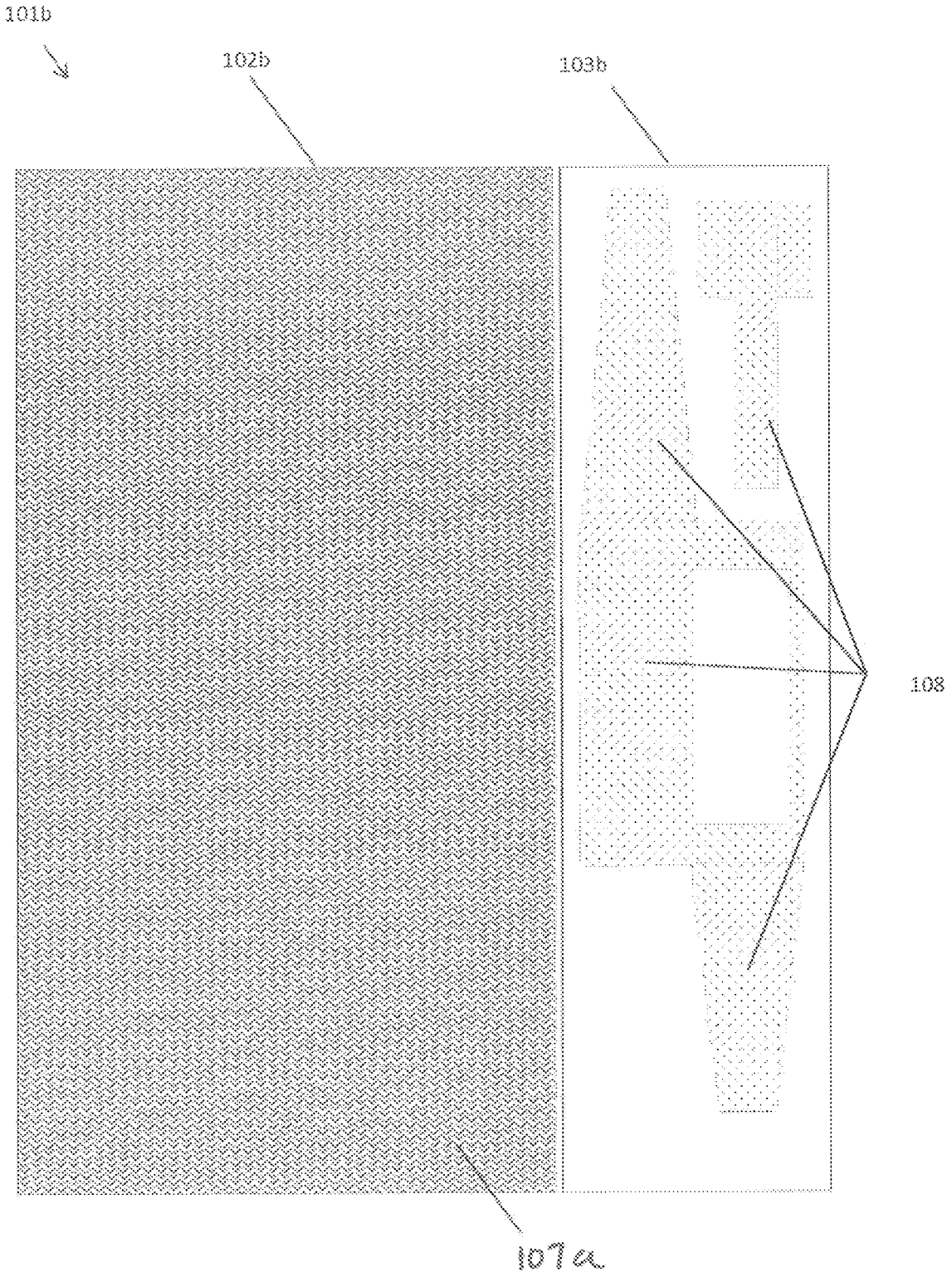
FIG. 3 is a back side view of the combination wristband and label form showing an adhesive and silicone pattern according to the embodiment of FIG. 1.
Figure 4:
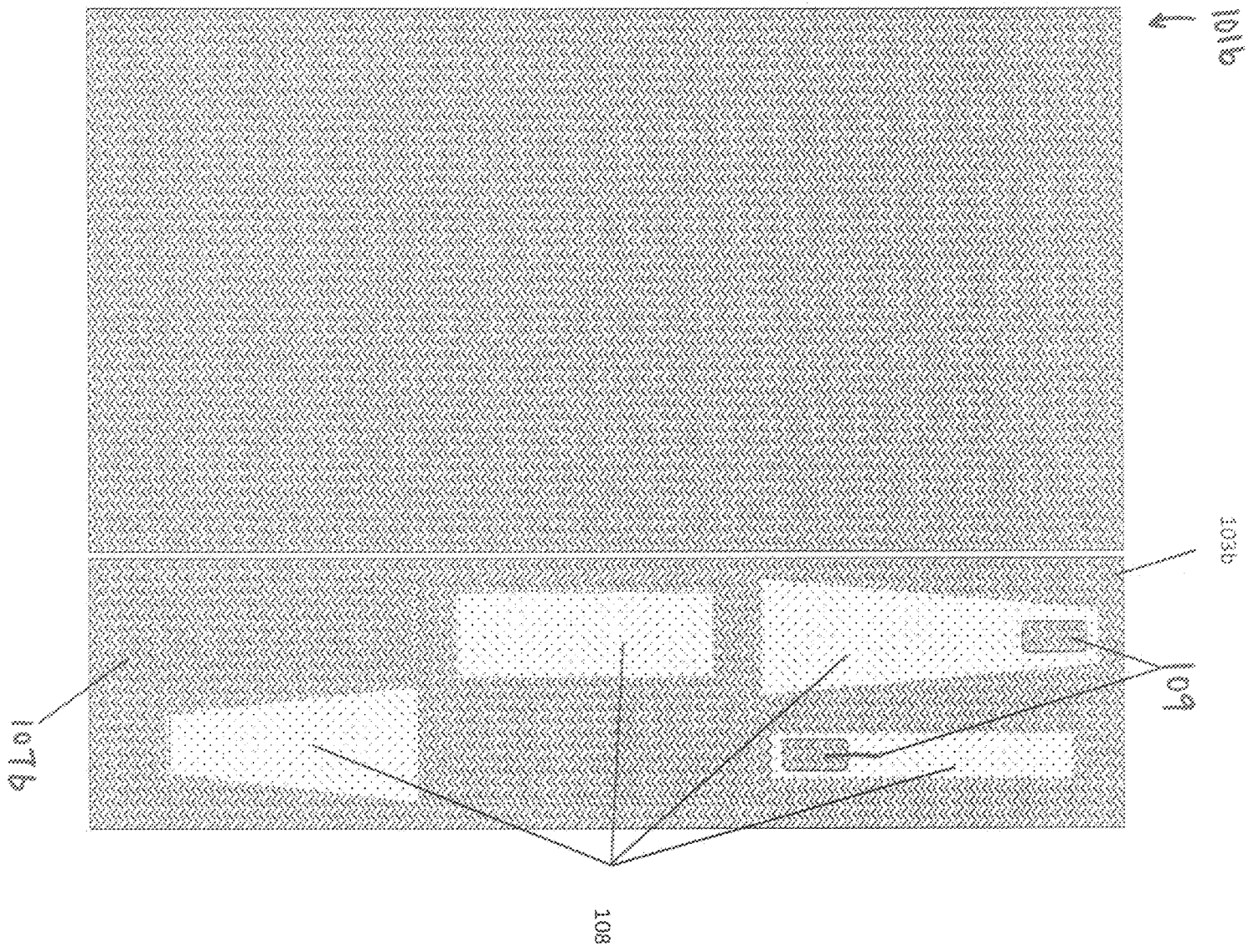
FIG. 4 is a back side view of an alternative embodiment of adhesive and silicone patterns of the form of FIG. 1.

With reference now to the figures, FIG. 1 illustrates one embodiment of a combination wristband and label form 100. The form 100 includes a front sheet 101 adhered to a backing sheet 140. The front sheet 101 has a front side 101*f* and a back side 101*b* (FIGS. 3 and 4). The front sheet 101 may in some embodiments be separated into a top portion 102 and a bottom portion 103 having a relatively small gap therebetween. The top portion 102 and the bottom portion 103 may each have a front face 102*f* and 103*f*, and a back face 102*b* and 103*b*, respectively. The top portion 102 and the bottom portion 103 may be separated by a vertical perforation 111.

The front surface 102*f* of the top portion 102 may include a plurality of labels 107. The labels 107 may be arranged in columns and rows, for example, 4×6. However, the labels 107 may be provided in any combinations of columns (e.g., 1, 2, 3, 4, etc.) and rows (e.g., 1, 2, 3, 4, etc.). The labels 107 may be configured to receive indicia. Accordingly, the front surface 102*f* may be constructed of paper or other appropriate textile sufficient for receiving ink, e.g., from a printer or other marking device.

The labels 107 may have a variety of constructions. For example, the figures illustrate the labels 107 as having a generally rectangular configuration. However, the labels 107 may be square, circular, polygonal, etc. Additionally, a combination of label configurations may be employed on a single form 100.

The bottom portion 103*f* may comprise one or more outlines of wristbands 120. The wristbands 120 may include a paper area 105 which is be configured to be printable. In some embodiments, the form 100 may be configured to be passed through a printer so that indicia (e.g., patient name, patient medications, machine readable information such as barcodes, et cetera) may be printed directly on the wristband paper area 105. The paper area 105 may be die cut into the bottom portion 103*f*. In this manner, the paper area 105 may face the same direction as the labels 107, making it easier for indicia to be simultaneously printed on the labels 107 and the paper area 105.

Attention is now directed to FIGS. 3 and 4, which shows the back side 101*b* of the form 100. The back side 101*b* may include a back face 102*b* of the top portion 102 and a back face 103*b* of the bottom portion 103. The back face top portion 102*b* may include an adhesive area 107*a*. The adhesive area 107*a* may allow for the labels 107 to be releasably secured to the backing sheet 140. The back face bottom portion 103*b* may additionally have an adhesive area 107*b*. The adhesive area 107*b* may correspond to the area surrounding the wristband 120 which remains in place when the wristband 120 is removed from the form 100.

Figure 2:
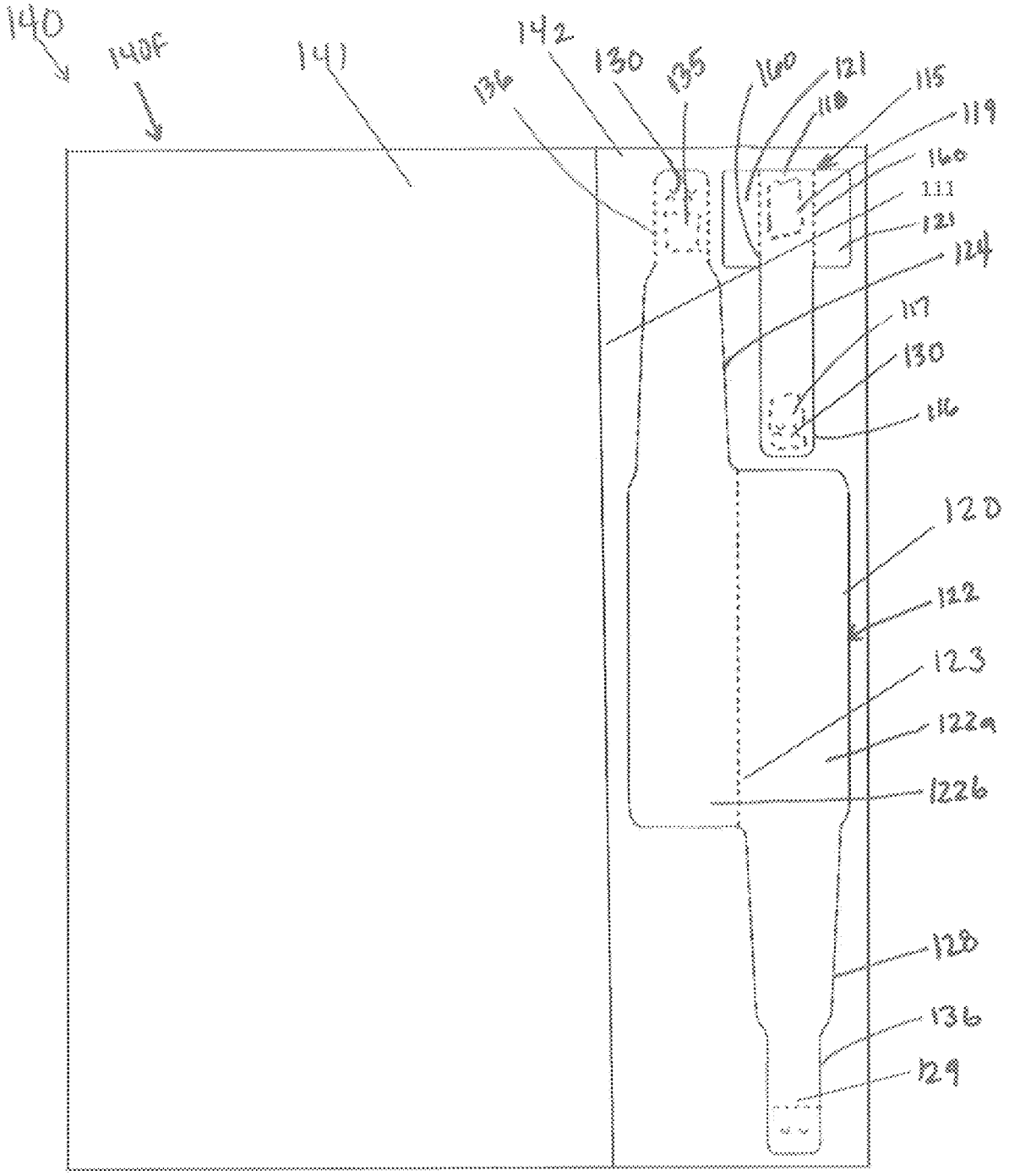
FIG. 2 is a back side view of the combination wristband and label form according to FIG. 1.

The adhesive areas 107*a* and 107*b* of the back faces 102*b* and 103*b* may adhere to a back side of the backing sheet 140, illustrated in FIG. 2. A top portion 141 of the backing sheet 140 may be constructed of paper or a synthetic resin, and the back side of the top portion 141 (not shown) may include a layer of silicone (or another similar release material) in the area corresponding to the adhesive area 107*a*. A back side of the bottom portion 142 of the backing sheet 140 may additionally include a layer of silicone in the area corresponding to adhesive area 107*b*, or may alternatively be permanently adhered to adhesive area 107*b* (such that the bottom portion 142 does not include a silicone layer). For example, the adhesive area 107*a* may releasably adhere to the silicone material on top portion 141, and adhesive area 107*b* may releasably (or permanently) adhere to bottom portion 142 as appropriate. The silicone material may be applied in a pattern which may allow for a more permanent adhesion between the backing sheet 140 and the front sheet 102 in areas void of silicone (e.g., the bond between the area of the bottom portion 142 surrounding the wristband 120 and the back side bottom portion 103*b* may be stronger than the bond between the top portion 102*b* and the top portion 141 of the backing sheet 140). This may keep the area of the bottom portion 142 surrounding the wristband 120 in place upon removal of the wristband 120. In some embodiments, the silicone material 107*b* may be completely omitted so that the area of the bottom portion 142 surrounding the wristband 120 permanently adheres to the back side bottom portion 103*b*.

As shown in FIG. 3, the back side bottom portion 103*b* may further include areas of silicone 108 which may coincide with the wristband 120. Additionally, as illustrated in FIG. 4, areas of adhesive 109 may be provided on the areas of silicone 108 to adhere the wristband 120 in place. Alternatively, as described below, adhesive 117, 119, and 135 may be applied to a back side of the backing 142 corresponding to portions of the wristband 120 and/or extension portion 115 in order to adhere the ends 124 and 128 of the wristband 120 together.

FIG. 2 illustrates the backing sheet 140 having a top portion 141 and a bottom portion 142. The wristband 120 may be die cut into the bottom portion 142 of the backing sheet 140, and may be defined by two laterally opposing sides (or ends) 124 and 128 which may extend directly (e.g., without a transition) from a central portion 122 having an upper portion 122*a* and a lower portion 122*b* separated by an indention 123. The laterally opposing sides (or ends) 124 and 128 may extend from the lower portion 122*b* and the upper portion 122*a*, respectively (or vice versa).

The sides 124 and 128 extend directly from a central portion 122, without any transition, such as a shoulder, or other type of transition. With such a configuration, the material required for the wristband 120 may be less than otherwise may be required. Further, the design is sleek, having no protrusions or other unneeded and/or unwanted areas of material extending from the central portion 122 and/or the sides 124 and 128.

As noted above, the upper portion 122*a* (or the lower portion 122*b*) of the central portion 122 may include a small paper area 205 that is removed from the front sheet 101 along with the wristband 120. The small paper area 105 may leave a small hole in the form 100 after removal therefrom. The wristband 120 may be configured to be self-laminating to protect the paper area 105. Accordingly, adhesive may be applied to surround the paper area 105 on the central upper portion 122*a*. Upon removal of the wristband 120 from the form 100, the wristband 120 may be folded about the indention 123 such that the adhesive on the central upper portion 122*a* adheres to the central lower portion 122*b* so that the paper area 105 is secured therebetween. Optionally, adhesive may be applied to the backside of the central lower portion 122*b* in addition to, or instead of adhesive applied to the backside of the central upper portion 122*a*.

One of the laterally opposed sides, e.g., side 128, may include perforations 129, and have no adhesive inwardly adjacent the perforations 129. The other laterally opposed side, e.g., side 124, may contain an area of adhesive 135 (FIG. 2) on a backside of the wristband 120, which may be in addition to the adhesive 109 provided on the face sheet portion back side 103*b*. Alternatively, the adhesive at side 124 may be provided instead of the adhesive 109. The adhesive 135 and/or 109 may keep the end 124 secured to the front sheet back side bottom portion 103*b*. The wristband 120 may be substantially held into position via the adhesive patch 135 and the perforated side 128. The wristband 120 may contain no adhesive apart from the adhesive 135 adjacent the end 124 and the adhesive surrounding the paper area 105 as described above.

The laterally opposing sides 124 and 128 of the wristband 120 may be generally rectangular. In one embodiment, the sides 124 and 128 are completely straight, without a taper. Alternatively, as shown in the figures, the sides 124 and 128 may gradually taper towards the end and may conclude in a tongue 136. Alternatively, the wristband 120 may take on other desirable shapes. In one embodiment, a height of the tongue 136 (e.g., end 124) may be less than a height of the remainder of the wristband 120 (including being less than the height of the end 128).

The wristband 120 may be further equipped with security slits 130. The security slits 130 may be configured to tear, should the wristband 120 be tampered with after the wristband 120 is applied to a wearer. This may be beneficial to ensure that the wristband 120 remains associated with the intended wearer, particularly in a healthcare environment where the wristband 120 includes patient-specific information.

In addition to the wristband 120, an extension portion 115 may be die cut into the bottom portion 142 of the backing sheet 140 to allow the wristband 120 to accommodate larger wrists. The extension portion 115 may include a first end 116 having an area of adhesive 117 on the backside thereof. A second end 118 may additionally have an area of adhesive 119 on the backside. Adhesive may not be located between the first and second ends of the extension portion 116 and 118, respectively. The second end 118 may additionally include arms 121 extending outwardly from the second end 118, and separated from the second end 118 by lines of perforation 160. Adhesive may be located on the backside of the arms 121. In one embodiment, the arms 121 may be separated from the second end 118 by tearing away at the lines of perforation 160. In another embodiment, the extension second end 118 may be aligned with an end 124 or 128 of the wristband 120 and placed thereupon. The arms 121 may then be folded about the lines of perforation 160, one at a time, to further secured the extension 115 to the wristband 120.

As noted above, the extension portion 115 may attach to either end 124 and 128 of the wristband 120, and may extend the reach of the band 120 my approximately one and one-half inches, for example, although other lengths may additionally or alternatively be accommodated. Further, the extension may also incorporate tamper evident slits 130.

The bottom portion 142 may be constructed of a synthetic material, such as polyester fabric or plastic, for example. Other materials may additionally, or alternately, be appropriate. Those of skill in the art may recognize that it may be beneficial for the wristband 120 material to be resistant to water or other liquid, which may cause the integrity of the wristband 120 to be prematurely compromised.

In use, after the wristband 120 has been printed, the user may peel the side 124 of the wristband 120 up and away from the form 100, inserting his or her finger under, for example, the bottom edge, until the finger exits at the top edge. The user may then tear the side 128 along the perforations 129 to free the wristband 120 from the form 100. Alternately, the user may hold the wristband 100, e.g., from the top or bottom edge, between his index finger and thumb, tear the side 128 along the perforations 129, and then separate the wristband 120, including the side 124 having the adhesive 119, from the form 100. In this way, the user may remove the wristband 120 from the form 100 in one generally continuous motion. The user may then fold the wristband 120 about the indention 123 and subsequently attach the wristband 120 to a person's wrist by wrapping the wristband 120 around the wrist, face up, and fastening the adhesive end (e.g., side 124) to the face of the wristband 120. The extension portion 115 may similarly be removed from the form 100 and secured to the wristband 120 as described above.

Such quick and convenient removal of the wristband 120 and/or the extension portion 115 from a single side (e.g., of the backing sheet 140) of the form 100 and its ready securement to a person's wrist may be preferable, as compared for example, to wristbands that must be removed from the associated forms in several steps. This may allow the user to save valuable time, especially where many wristbands 120 are utilized in a single setting. Further, the wristband 120 being removed from a single side of the form 100 eliminates the difficulty of the user having to access both sides of the form 100 in order to push one piece through in order to pull the remainder of the wristband off the form.

Figure 5:
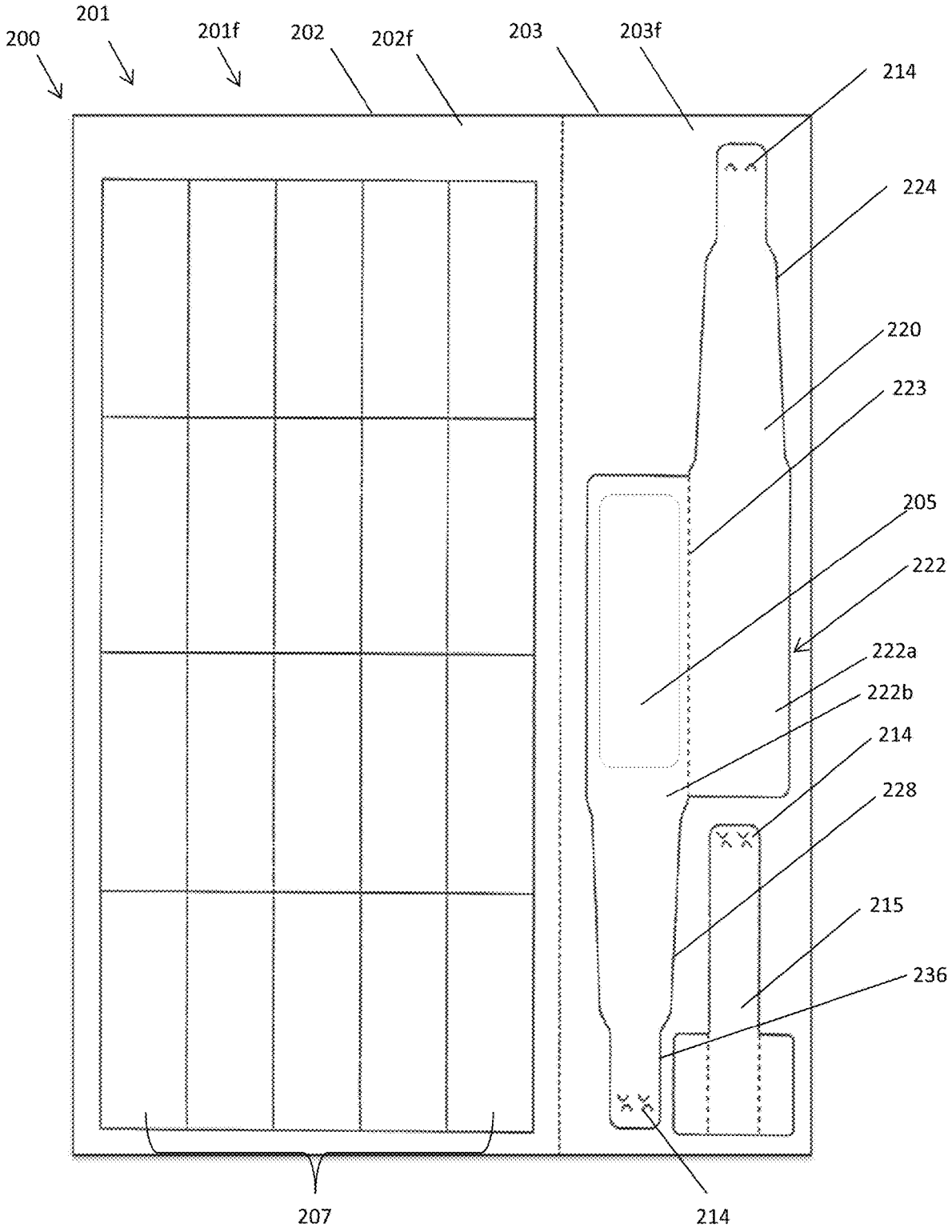
FIG. 5 is a front side view of a combination wristband and label form according to another embodiment of the invention.
Figure 6:
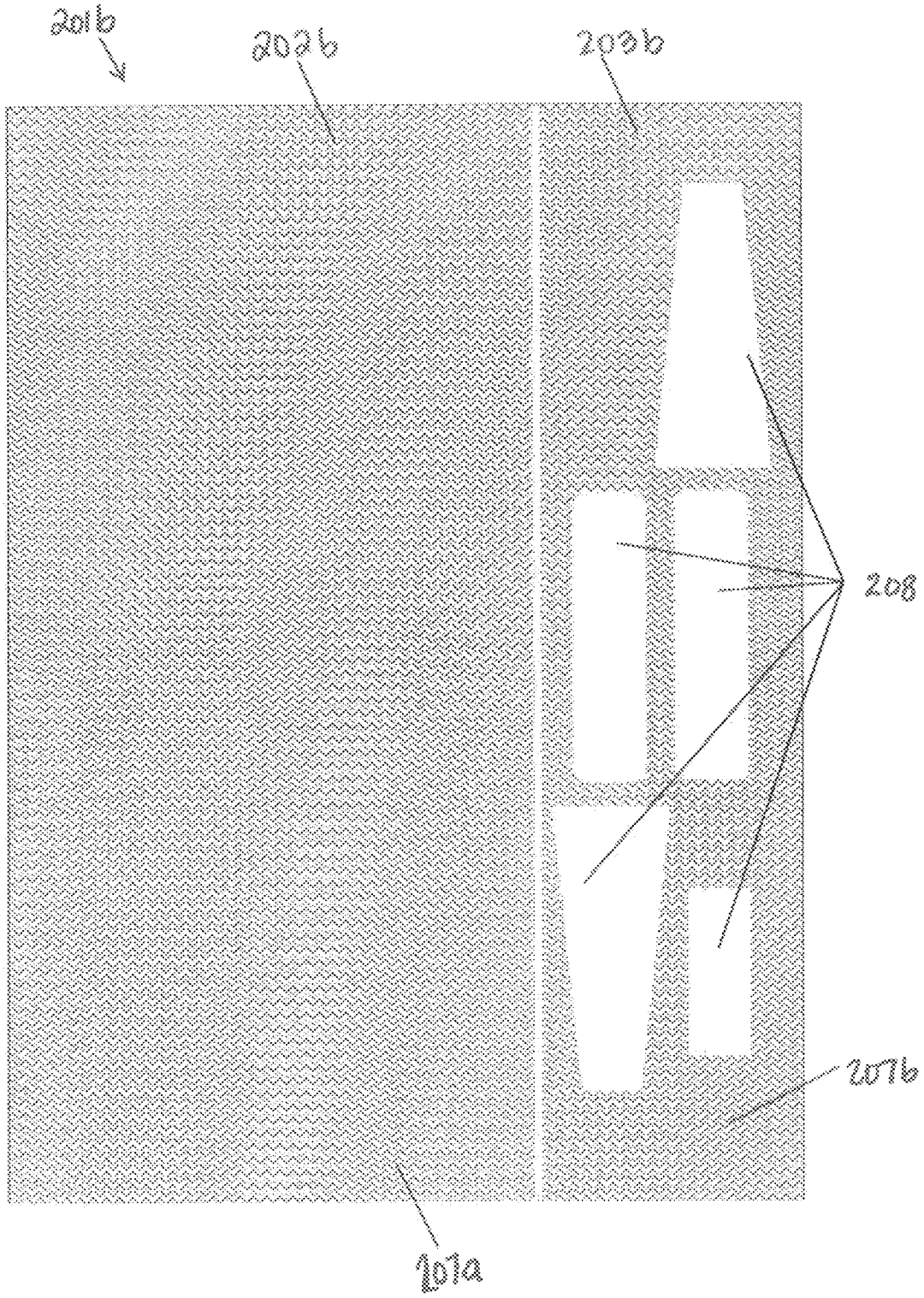
FIG. 6 is a back side view of the combination wristband and label form of FIG. 5.
Figure 7:
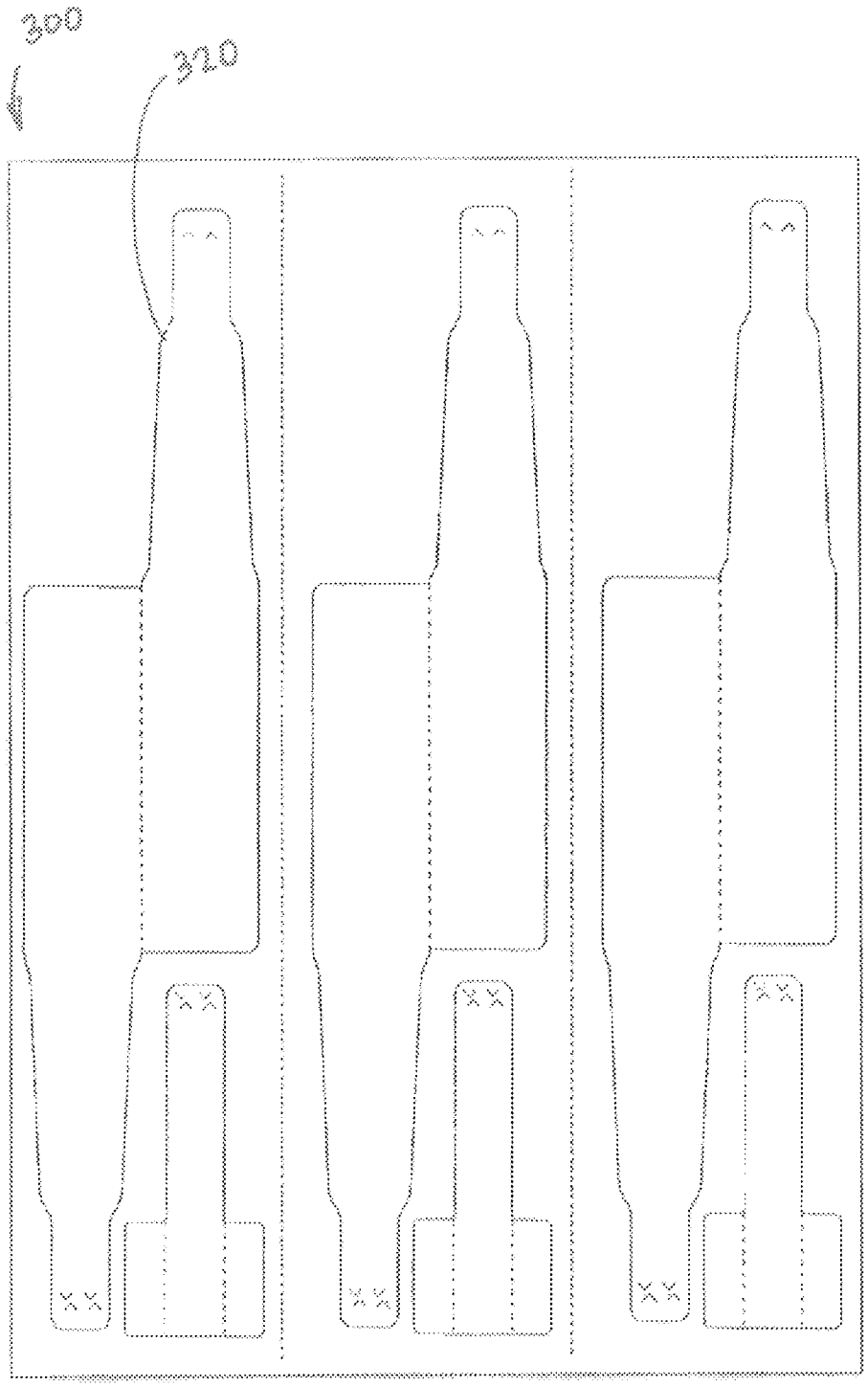
FIG. 7 is a front side view of an alternative embodiment of the form of FIG. 5.

Referring now to FIGS. 5-7, an alternative embodiment of a wristband 220 is illustrated which is similar to the wristband 120 except as shown and described herein. Here, the wristband 220 may be die cut into the bottom portion front face 203*f*, and may be defined by two laterally opposing sides (or ends) 224 and 228 which may extend directly (e.g., without a transition) from a central portion 222 having an upper portion 222*a* and a lower portion 222*b* separated by an indention 223. The laterally opposing sides (or ends) 124 and 128 may extend outwardly from the lower portion 222*b* and the upper portion 222*a*, respectively (or from the upper portion 222*a* and the lower portion 222*b*, respectively).

The sides 224 and 228 may be generally rectangular, and may be completely straight. Optionally, the sides 224 and 228 may taper aware from the central portion 222 and conclude in a tongue 226, similar to the wristband 120 described above. One or both ends 224 and 228 may include tamper evident slits 214, configured to tear should the wristband 220 be tampered with after the wristband 220 is applied to the wearer.

The lower portion 222*b* (or the upper portion 222*a* as the case may be) of the central portion 222 may include a small laser printable area 205 which may allow indicia to be printed on the wristband 220 without having to provide a paper area. Further, the laser printable area may allow for the wristband 220 to be removed from the form 200 without leaving a hole in the form 200.

An extension band 215, substantially similar to extension band 115 may additionally be included with the wristband 220 on the front face bottom portion 203*b*.

Referring now to FIG. 6, which illustrates a back side 201*b* of the form 200, adhesive areas 207*a* and 207*b* may be provided. It may be advantageous to additionally have areas 208 without adhesive. The adhesive areas 207*a* and 207*b* may adhere to a backing sheet which may be made of, for example, paper or synthetic resin and may be generally similar to back sheet 140. The backing sheet may include silicone or other suitable release material on the side of the backing sheet which contacts the adhesive areas 207*a* and 207*b*. This may thus allow the top portion 202 and bottom portion 203 to be releasably adhered to the backing sheet. As can be seen my comparing FIGS. 5 and 6, the area of adhesive 207*b* may be such that it encompasses a portion of the sides 224 and 228, and further such that adhesive is provided around the perimeter(s) of the central upper and lower portions 222*a* and 222*b*.

The configuration of the wristband 220 on the form 200 may be such that the adhesive ends 224 and 228 are initially all facing the same direction (e.g., toward the backing sheet). Upon folding the wristband 220 about the indention 223, the adhesive covered ends 224 and 228 may face in opposite directions such that they meet back to back, thus forming a solid adhesion to the wristband 220 (or the extension portion 215) and not exposing the adhesive to the patient.

In use, a user may peel the wristband 220 from the form 200, wherein the adhesive remains at the desired location on the underside of the wristband. The wristband 220 may be peeled from the form 200 in a similar manner as that described above regarding wristband 120. Specifically, a user may insert his or her finger under the wristband 220 from the bottom edge, the finger exiting under the top edge. The user may then slide his or her finger toward one of the ends (e.g., end 228) to release the adhesive under the end 228 from the backing. The user may then grasp the end (e.g., 228) and peel the rest of the wristband 220 from the backing. Therefore, as with the wristband 120, the wristband 220 may similarly be pulled from a single side of the form 200.

When the wristband 220 is removed from the form 200, the area of the backing sheet behind the wristband 120 may remain intact. Such a configuration may provide several benefits over prior art wristbands. For example, as noted above, other methods may consist of "punching out" the wristband from the form leaves a void that may prevent the rest of the form from being used at a later time. However, if the form remains intact, as in the present invention, it may be used multiple times, for example, to print on the labels 207. This may be beneficial because it is often desirable to print the labels 207 at different times (for example, it may be desirable to print new labels 207 to reflect changes made to medications prescribed to a patient during the course of his treatment). A new label 207, such as a label 207 leftover on the form 200, may thus be printed with the new information until all the labels 207 have been used. Of course, the labels 207 may be used for any desirable purposes, such as for labeling patient files and other documents, vials, etc. The labels 207 may all be printed with information in a single pass through the printer, or the form 200 may be passed through the printer multiple times such that the labels 207 are printed as needed.

In another embodiment, illustrated in FIG. 7, a form 300 may consist of a plurality of wristbands 320 (which may be wristband 120, 220, or another alternative wristband) and does not include labels 107 and 207. Alternately, a form may include only a single wristband. The form 300 may be approximately the size of a standard piece of paper (e.g., 8½"×11"), or the form may be tailored to the size of the required wristbands and/or labels. For example, if only a single wristband is required, the form may be only the size necessary to contain one wristband.

Figure 8:
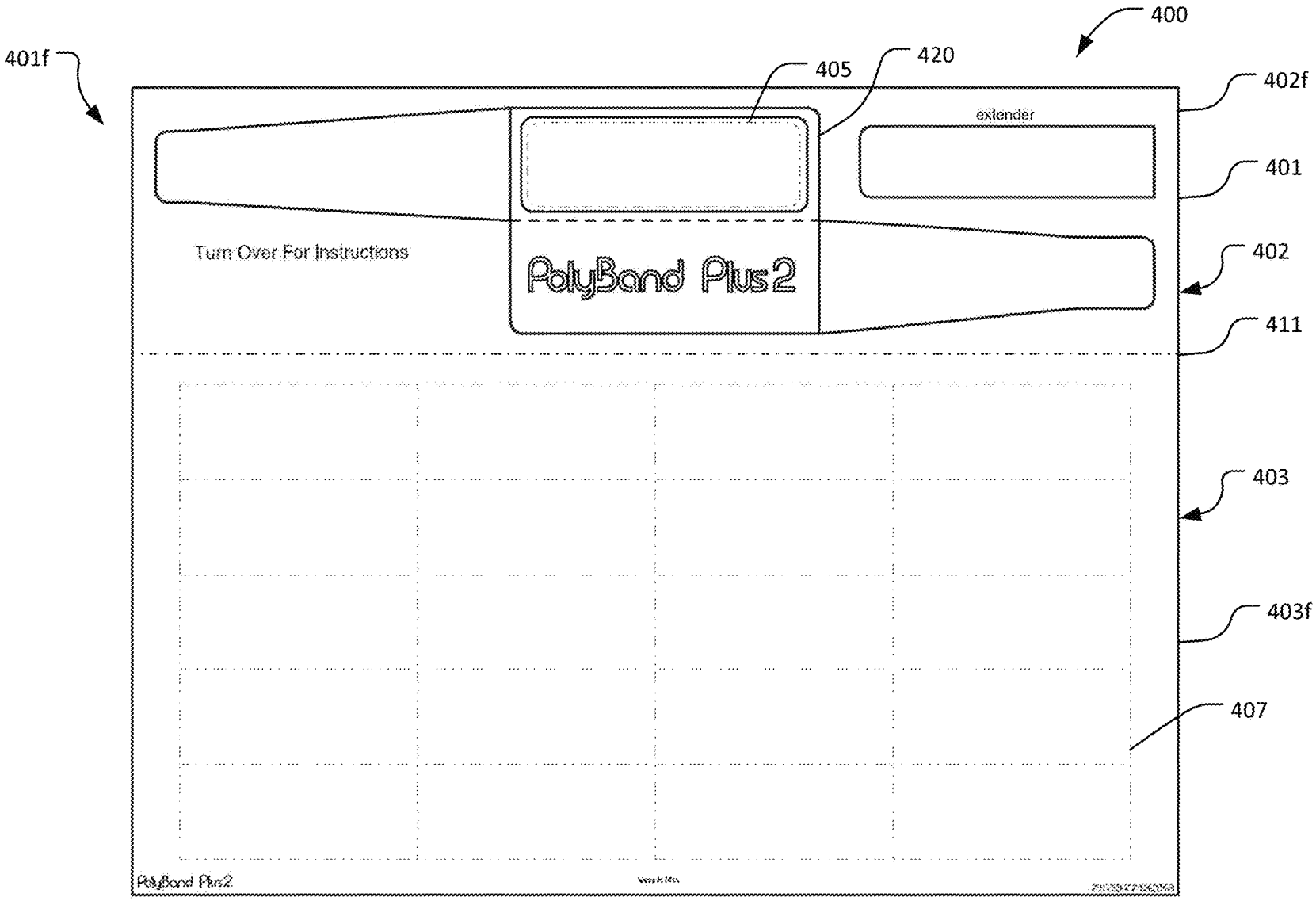
FIG. 8 is a front view of a front side of a combination wristband and label form according to another embodiment of the invention.
Figure 9:
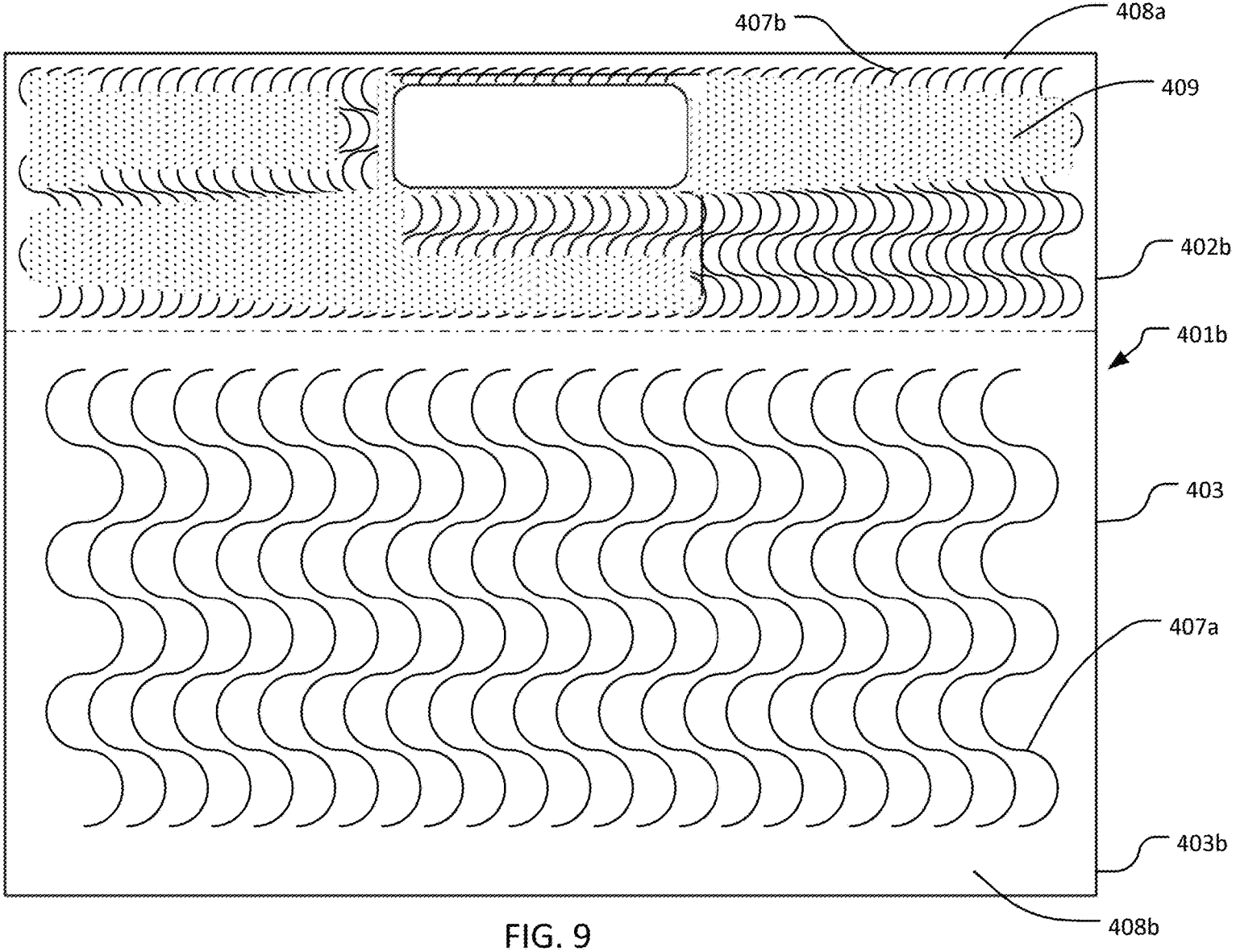
FIG. 9 is a back view of the front side of the combination wristband and label form of FIG. 8.

Moving on, FIGS. 8-11 illustrate yet another embodiment of a combination wristband and label form 400. The form 400 includes a front sheet 401 adhered to a back sheet 440. The front sheet 401 has a front side 401*f* and a back side 401*b* (FIGS. 8 and 9, respectively). The front sheet 401 may in some embodiments be separated into a top portion 402 and a bottom portion 403 having a relatively small gap therebetween. The top portion 402 and the bottom portion 403 may thus each have a front face 402*f* and 403*f*, and a back face 402*b* and 403*b*, respectively. The top portion 402 and the bottom portion 403 may be separated by a perforation 411.

The front face 403*f* of the bottom portion 403 may include a plurality of labels 407. As noted above, the labels 407 may be arranged in columns and rows, for example, 4×6. However, the labels 407 may be provided in any number of combinations of columns (e.g., 1, 2, 3, 4, etc.) and rows (e.g., 1, 2, 3, 4, etc.). The labels 407 may be configured to receive indicia. Accordingly, the front face 403*f* may be constructed of paper or other appropriate textile sufficient for receiving ink, e.g., from a printer or other marking device.

The labels 407 may have a variety of constructions. For example, the figures illustrate the labels 407 as having a generally rectangular configuration. However, the labels 407 may be square, circular, polygonal, etc. Additionally, a combination of label configurations may be employed on a single form 400.

The front face 402*f* of the top portion 402 may comprise one or more outlines of a wristband 420. An indicia-receiving area 405 may be defined within the outline 420, and may be die cut into the top portion. In some embodiments, rather than a die cut indicia-receiving area, a void may be formed into the top portion 402 such that a top portion back side 441*b* of the back sheet 440 (FIG. 11) is accessible through the void. In embodiments, a generally opaque substance (e.g., one or more layers of translucent or opaque ink, paint, or other such coating) configured to receive indicia may be disposed on the top portion back side 441*b* of the back sheet 440 in the area of the void to form the indicia-receiving area 405. In these embodiments, the wristband may be completely devoid of the paper ply traditionally used for the printing of indicia on the wristband. More specifically, wristbands traditionally include a paper area (e.g., paper area 105 in FIG. 1) on which indicia is printed and which paper area is thereafter laminated by a panel of the wristband when the wristband is folded (e.g., along indentation 123 in FIG. 1). In embodiments of the present disclosure, however, the wristband may be devoid of the paper area; indicia may instead be printed directly onto the generally opaque coating (e.g., the generally opaque ink) and laminated thereafter by a wristband panel when the wristband is folded along indentation 423, as discussed herein. In these embodiments, the wristband itself may thus comprise only a single ply (formed, e.g., of polyester, plastic, fabric, and/or other suitable materials). The single-ply wristband may, in applications, be considered more desirable relative to the two-ply wristbands because of the lower manufacturing costs, reduced thickness, et cetera. In other embodiments, the indicia receiving area 405 may comprise paper.

In any event, the indicia-receiving area 405 (both, in embodiments of the wristband comprising a paper area and in embodiments of the wristband devoid of the paper area) may be configured to be printable. In some embodiments, the form 400 may be configured to be passed through a printer so that indicia (e.g., patient name, patient medications, machine readable information such as barcodes, et cetera) may be printed directly on the wristband indicia-receiving area 405. The indicia-receiving area 405 may face the same direction as the labels 407, making it easier for indicia to be simultaneously printed on the labels 407 and the indicia-receiving area 405.

Attention is now directed to FIG. 9, which shows the back side 401*b* of the front sheet 401 of the form 400. The back side 401*b* may include a top portion back face 402*b* and a bottom portion back face 403*b*, which may be separated by a small gap. The bottom portion back face 403*b* may include an adhesive area 407*a*. The adhesive area 407*a* may allow for the labels 407 to be releasably secured to the back sheet 440. In embodiments, a perimeter 408*b* is defined between an outside edge of the bottom portion back face 403*b* and the adhesive area 407*a*. The top portion back face 402*b* may additionally have an adhesive area 407*b*. The adhesive area 407*b* may correspond to the area surrounding the wristband 420 which remains in place when the wristband 420 is removed from the form 400 as is described in greater detail below. Similarly, a perimeter 408*a* may be defined between an outside edge of the top portion back face 402*b* and the adhesive area 407*b*.

Figure 10:
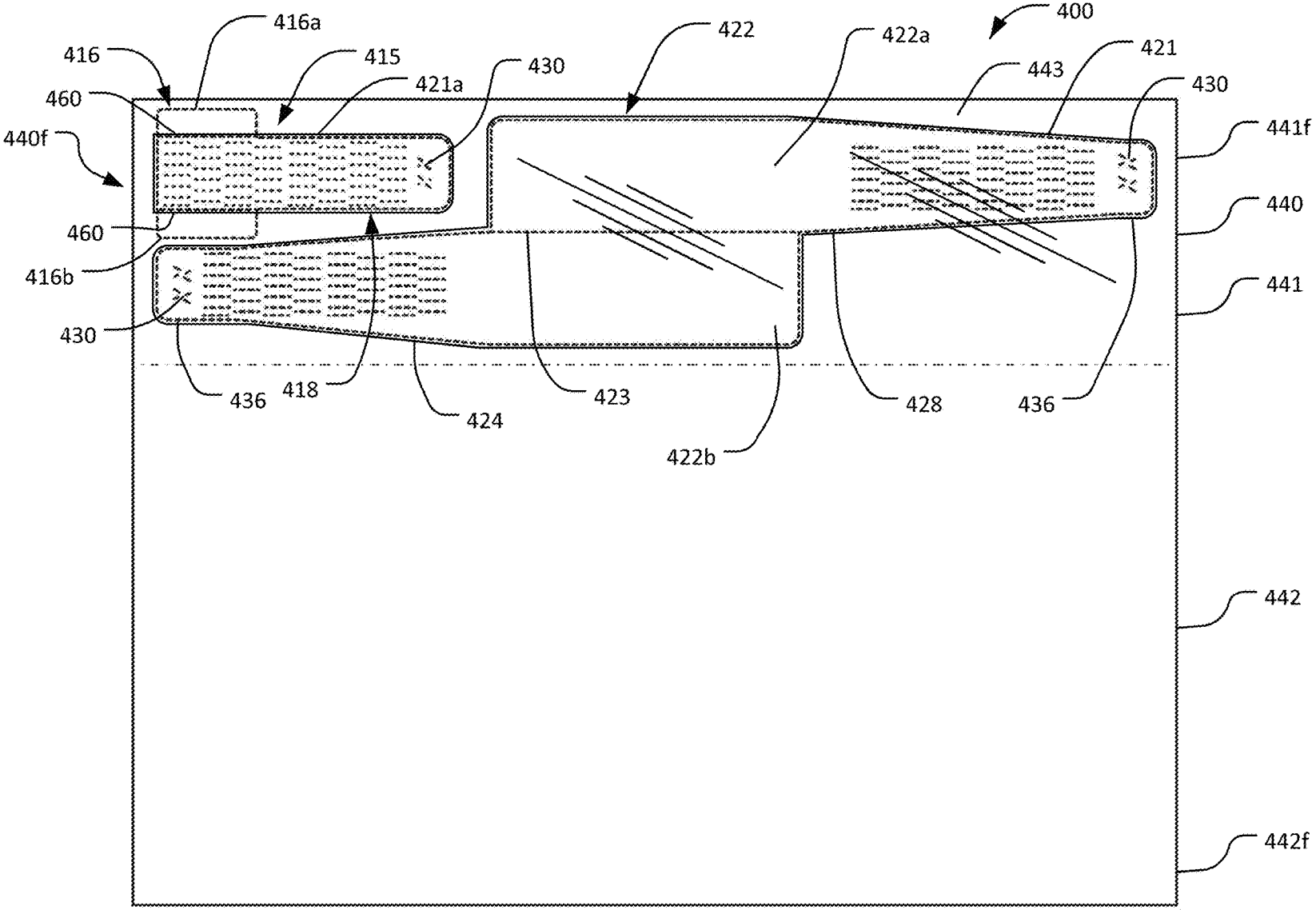
FIG. 10 is a front view of a back side of the combination wristband and label form of FIG. 8.
Figure 11:
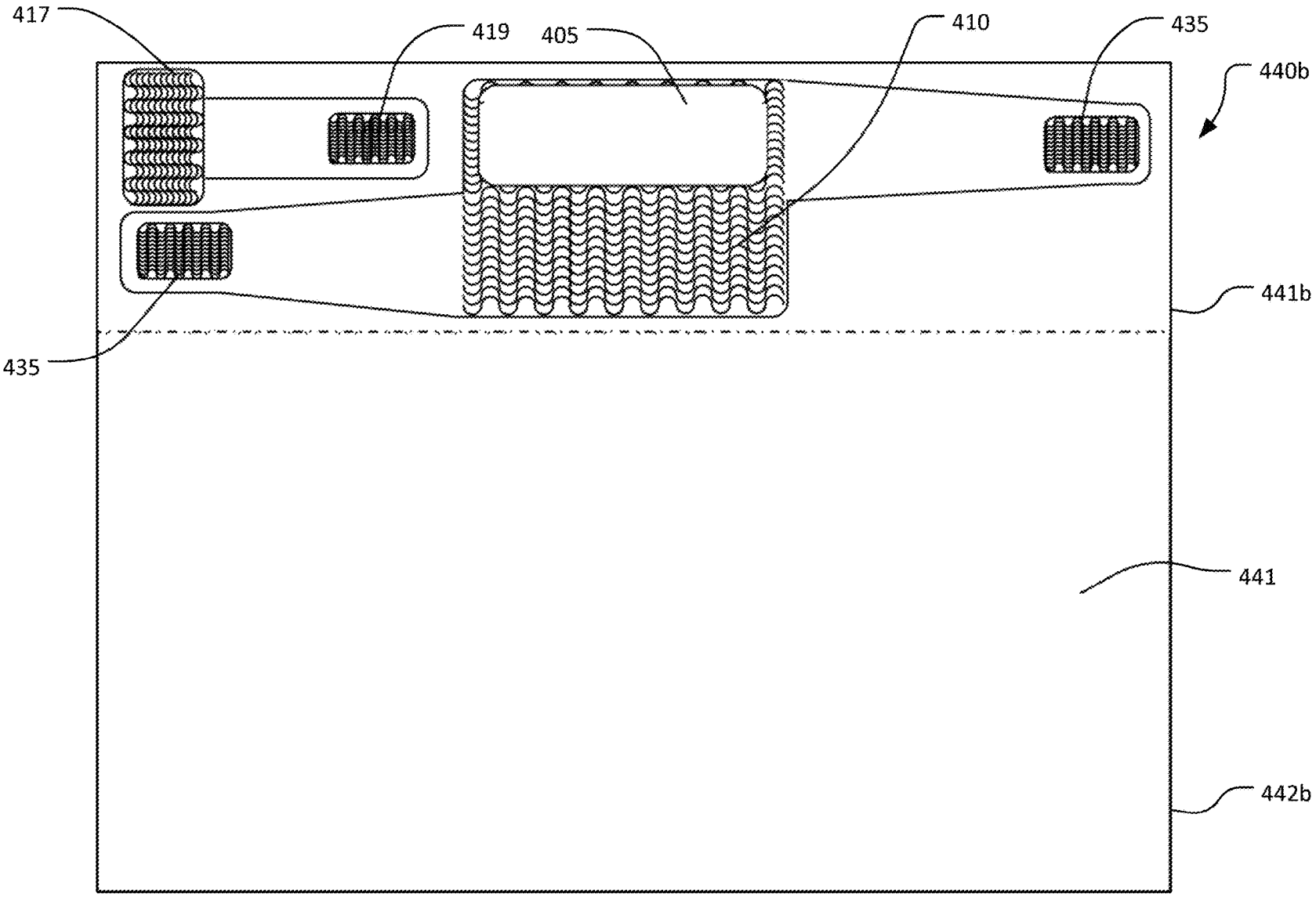
FIG. 11 is a back view of the back side of the combination wristband and label form of FIG. 8.
Figure 12:
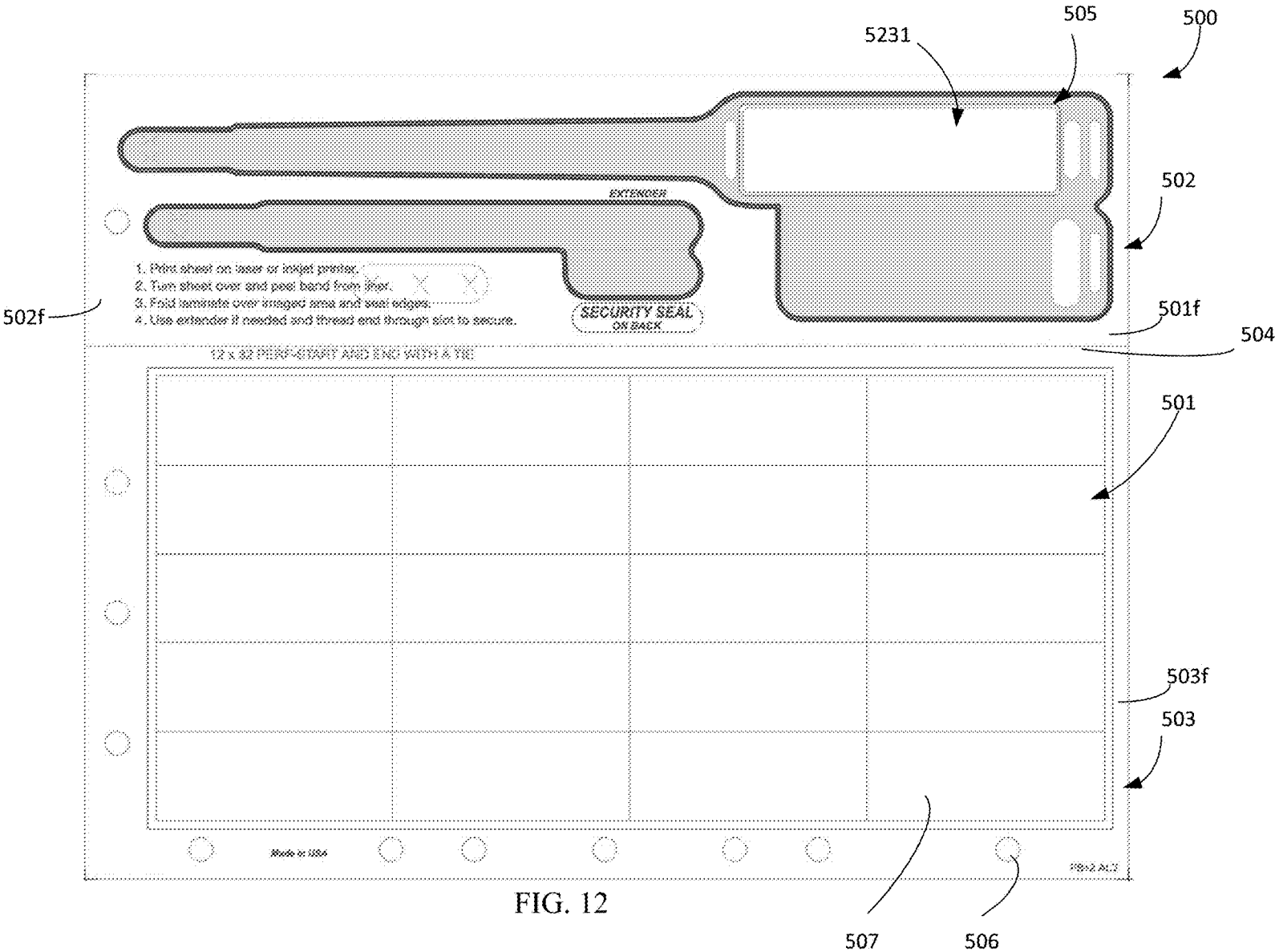
FIG. 12 is a front view of a front sheet of a wristband and label form according to another embodiment.

The adhesive areas 407*b* and 407*a* of the back faces 402*b* and 403*b* may allow adherence of the back side 401*b* of the front sheet 401 to a back side 440*b* of the back sheet 440, illustrated in FIG. 11. To prevent permanent adherence of the back side 440*b* to the back side 401*b*, the back face 402*b* of the top portion 402 may include a layer of silicone in the area corresponding to the die cut wristband 420, and may further include a layer of silicone in the area corresponding to the adhesive area 407*b* (e.g., the adhesive area 407*b* may be applied above the layer of silicone). Alternately, the back face 402*b* may be devoid of silicone in the area corresponding to the adhesive area 407*b* such that the back sheet top portion 441 is substantially permanently adhered to the front sheet top portion 402 in the area of the adhesive 407*b*. In some embodiments, the silicone material (if present) may be applied in a pattern which may allow for a somewhat less permanent adhesion between the back sheet top portion 441 and the front sheet top portion 402 in the areas with patterned silicone. In any event, the area 443 of the back sheet top portion 441 surrounding the die cut wristband 421 (FIG. 10) will preferably remain in place upon removal of the wristband 421 from the form 400.

A bottom portion 442 of the back sheet 440 may be constructed of paper or a synthetic resin, and the back side 442*b* of the bottom portion 442 may include a layer of silicone (or another similar release material) in an area generally corresponding to the adhesive area 407*a*. The layer of release material allows the back sheet 440 to be removably adhered to the front sheet 401. Thus, when combined, the back sheet bottom portion 442 is adhered to the front sheet bottom portion 403 via the adhesive 407*a*. The back sheet bottom portion 442 remains adhered to the front sheet bottom portion 403 until it is removed (or a portion of it is removed) by a user.

As noted briefly above, the back sheet top portion 441 includes a die cut of a wristband 421 (FIG. 10). A die cut of other wristband accessories, such as a wristband extension 421*a*, may additionally be included in the back sheet top portion 441. The wristband 421 may be defined by two laterally opposing sides (or ends) 424 and 428 which may extend directly (e.g., without a transition) from a central portion 422 having an upper portion 422*a* and a lower portion 422*b* separated by an indention 423. The laterally opposing sides (or ends) 424 and 428 may extend from the lower portion 422*b* and the upper portion 422*a*, respectively (or vice versa).

Similar to the other embodiments, the sides 424 and 428 extend directly from a central portion 422, without any transition, such as a shoulder, or other type of transition. With such a configuration, the material required for the wristband 421 may be less than otherwise may be required. Further, the design is sleek, having no protrusions or other unneeded and/or unwanted areas of material extending from the central portion 422 and/or the sides 424 and 428.

The upper portion 422*a* (or the lower portion 422*b*) of the central portion 422 may include a small indicia-receiving area 405 that is removed from the front sheet 401 along with the wristband 421. The indicia-receiving area 405 may comprise a generally opaque printable coating (e.g., ink, paint, etc.) and the wristband may be a one-ply wristband (i.e., the indicia-receiving area 405 may be integral to the wristband); alternately, the indicia-receiving area 405 may comprise paper that is adhesively secured to the wristband and the wristband may be a two-ply wristband. Removal of the wristband 421 may leave a hole in the front sheet 401.

The wristband 421 is configured to be self-laminating to protect the indicia-receiving area 405. Accordingly, adhesive 410 may be applied to the wristband back side 441*b* in an area surrounding the indicia-receiving area 405, as shown in FIG. 11. Adhesive 410 may not be present on the indicia-receiving area 405 itself. Further, adhesive 410 may be applied to the entire, or substantially entire, area of the central portion (either 422*a* or 422*b*) that does not have the indicia-receiving area 405. Upon removal of the wristband 421 from the form 400, the wristband 421 may be folded about the indention 423 such that the adhesive 410 on the central upper portion 422*a* adheres to the adhesive 410 on the central lower portion 422*b* sandwiching the indicia-receiving area 405 therebetween.

The laterally opposed sides 424 and 428 may contain an area of adhesive 435 (FIG. 11) on a backside of the wristband 421. The adhesive 435 may keep the ends 424 and 428 of the wristband 421 secured to the front sheet back side top portion 402*b*. The wristband 421 may be substantially held into position to the front sheet back side top portion 402*b* via the adhesive areas 410 and 435. The wristband 421 may contain no adhesive apart from that described above.

The laterally opposing sides 424 and 428 of the wristband 421 may be generally rectangular. In some embodiments, the sides 424 and 428 are entirely straight, without a taper. Alternately, as shown in the figures, the sides 424 and 428 may gradually taper towards the end and may conclude in a tongue 436. The wristband 420 may alternately have other shapes, as desired. In embodiments, a height of the tongue 436 (e.g., at end 424) may be less than a height of the remainder of the wristband 421 (including being less than the height of the end 428).

The wristband 421 may be further equipped with security slits 430. The security slits 430 may be configured to tear, should the wristband 421 be tampered with after the wristband 421 is applied to a wearer. This may be beneficial to ensure that the wristband 421 remains associated with the intended wearer, particularly in a healthcare environment where the wristband 421 includes patient-specific information.

Similar to the embodiments described above, in addition to the wristband 421, an extension portion 415 may be die cut into the top portion 441 of the backing sheet 440 to allow the wristband 421 to accommodate larger wrists. The extension portion 415 may include a first end 416 having an area of adhesive 417 on the backside thereof. A second end 418 may additionally have an area of adhesive 419 on the backside. Adhesive may not be located between the first and second ends of the extension portion 416 and 418, respectively. The first end 416 may additionally include arms 416*a* and 416*b* extending outwardly from the first end 416, and separated from the first end 416 by lines of perforation 460. Adhesive may be located on the backside of the arms 416*a* and 416*b*. In some embodiments, the arms 416*a* and 416*b* may be separated from the first end 416 by tearing away at the lines of perforation 460. In other embodiments, the extension first end 416 may be aligned with an end 424 or 428 of the wristband 120 and placed thereupon. The arms 416*a* and 416*b* may then be folded about the lines of perforation 460, one at a time, to further secured the extension 415 to the wristband 421. Further, the extension 415 may further incorporate tamper evident slits 430.

The top portion 441 of the back sheet 400 may be constructed of a synthetic material, such as polyester fabric or plastic, for example. Other materials may additionally, or alternately, be appropriate. Those of skill in the art may recognize that it may be beneficial for the wristband 421 material to be resistant to water or other liquid, which may cause the integrity of the wristband 421 to be prematurely compromised.

In use, after the wristband 421 has been printed, the user may remove the wristband 421 from the form 400 as described above regarding embodiments 100, 200, and/or 300.

FIGS. 12-15 disclose an alternate embodiment 500 of the wristband and label form 100. The artisan will understand the embodiment 100, and thus the embodiment 500, may be modified as desired, such as in view of the disclosure relating to the other embodiments disclosed herein.

Figure 13:
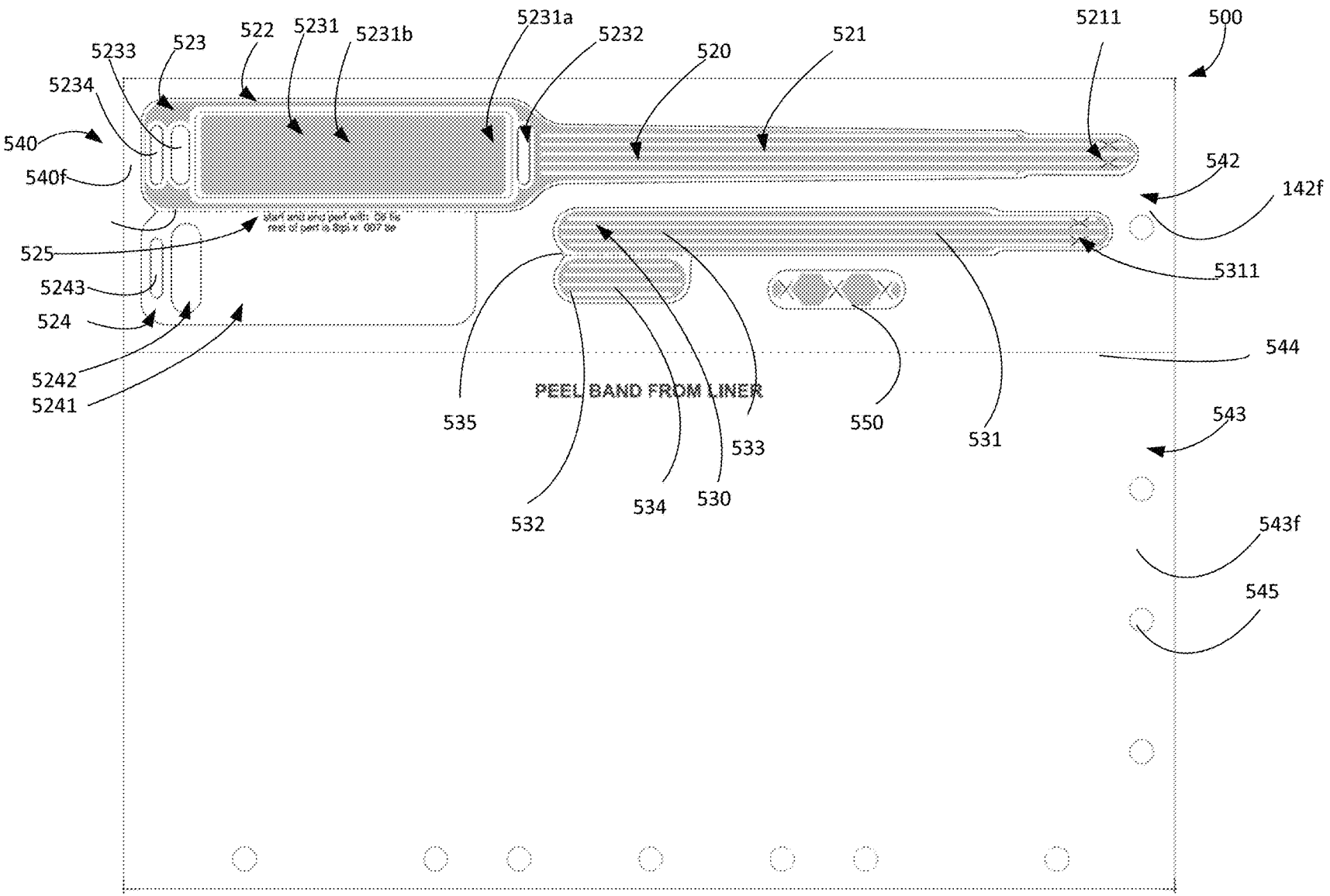
FIG. 13 is a front view of a back sheet of the wristband and label form of the embodiment of FIG. 12.

The wristband and label form 500 may include a front sheet 501 (FIG. 12) adhered to a back sheet 540 (FIG. 13). The front sheet 501 has a front side 501*f* (FIG. 12) and a back side and may be made of paper or other appropriate material. The front sheet 501 may in some embodiments be separated into a top portion 502 and a bottom portion 503. The top portion 502 and the bottom portion 503 may each have a front face 502*f* and 503*f*, and a back face, respectively. The top portion 502 and the bottom portion 503 may be separated by a horizontal perforation line 504.

The back sheet 540 has a front side 540*f* (FIG. 13) and a back side and may be made of one or more of plastic and/or other synthetic materials. The back sheet 540 may be separated into a top portion 542 and a bottom portion 543. The top portion 542 and the bottom portion 543 may each have a front face and a back face, respectively. The top portion 542 and the bottom portion 543 may be separated by a horizontal perforation line 544. The perforation line 544 may extend parallel to and coincide with perforation line 504.

The front surface 503*f* of bottom portion 503 may include a plurality of die cut holes 506 and die cut labels 507. The labels 507 may be arranged in columns and rows, for example, 4×5. However, the labels 107 may be provided in any combinations of columns (e.g., 1, 2, 3, 4, etc.) and rows (e.g., 1, 2, 3, 4, etc.). The labels 507 may be configured to receive indicia. Accordingly, the front surface 503*f* may be constructed of paper or other appropriate textile configured for receiving ink, e.g., from a printer or other marking device. In embodiments, the labels 507 may be provided in a different configuration or may be omitted.

The top portion 502 may have a cut-out 505 through which a print area 5231 of a wristband 520 in the back sheet 540 may be accessible. The print area 5231 may be printed with indicia (e.g., patient name, patient medications, machine readable information such as barcodes, et cetera) through the cut-out 505. The print area 5231 may face the same direction as the labels 507 of the front surface 503*f*, making it easier for indicia to be simultaneously printed on the labels 507 and the print area 5231.

In embodiments, the print area 5231 may be formed of printable coating, such as an opaque or translucent coating configured to receive ink, that is disposed on the plastic material forming the wristband 520. The print area 5231 may be devoid of paper, as is traditionally found in the print areas of laminated patient identification wristbands. In embodiments, the print area, i.e., the printable ink thereof, may be inset from the cut-out portion 505.

In some embodiments, the form 500 may be configured to be passed through a printer so that indicia (e.g., patient name, patient medications, machine readable information such as barcodes, et cetera) may be printed directly on the wristband print area 5231 and/or the labels 107 in a single pass.

The back sheet 540 may include a plurality of die cut holes 545 which match die cut holes on the front sheet 501. In addition, the top portion 502 of the front sheet 501 may include one or more printed outlines of a wristband 520 representative of the wristband 520 on the back sheet 540. On the back sheet 540, the wristband 520, which may comprise plastic or other desirable materials, may be die-cut into the front face 542*f* of the top portion 542.

In embodiments, the wristband 520 may comprise a terminal portion 522 having an upper portion 523 and a lower portion 524 separated by a perforation line 525 therebetween. A solitary arm portion 521 may extend inboard laterally from the terminal portion 522, e.g., from the upper portion 523 (or the lower portion 524) thereof.

The arm portion 521 may include tamper evident slits 5211 configured to tear should the wristband 520 be tampered with after the wristband 520 is applied to the wearer.

The upper portion 523 of the terminal portion 522 may have a length that is greater than a length of the lower portion 524 of the terminal portion 522. The upper portion 523 may include a first slot 5232, a second slot 5233, and a third slot 5234. The first slot 5232 may be inboard the second slot 5233 and the second slot 5233 may be inboard the third slot 5234. That is, the first slot 532 may be proximate the arm portion 521 relative to the second slot 5233 and the third slot 5234.

The first slot 5232 may be laterally positioned between the print area 5231 and the arm portion 521, and the first slot 5232 may be die-cut into the front surface 542*f* of the top portion 542. The second slot 5233 and the third slot 5234 may be positioned outboard the print area 5231 away from the arm portion 521 and may similarly be die-cut into the front surface 542*f* of the top portion 542. The first slot 5232 and the third slot 5234 may be of the same size, and the second slot 5233 may be bigger in size than the first slot 5232 and the third slot 5234.

In some embodiments, one of the second slot 5233 and third slot 5234 may be omitted. In embodiments where both the second slot 5233 and third slot 5234 are present, as illustrated in the figures, the size of the second slot 5233 may be kept bigger than that of the third slot 5234. That is, slot 5233 may be bigger than the slot 5234 which is outboard relative to slot 5233. It has been found that increasing the size of the inboard second slot 5233 increases the flexibility of the portion of the wristband 120 outboard the print area 5231, which may be desirable particularly when the wristband is secured to a wrist of the user. That is, the removal of additional material to create the larger slot 5233 makes the entire end piece outwardly adjacent the print area 5231 more bendable as compared to a wristband where the slots 5233 and 5234 are of the same smaller size. As discussed, this may be desirable because it allows the area outboard the print area 5231 to bend with the user's wrist while the wristband 520 is secured around the user's wrist. Further, it has been found that unduly increasing the size of the outboard (or third) slot 5234 is counterproductive because the third slot 5234 is adjacent and proximate an edge of the wristband 520 and increasing the size thereof undesirably affects structural integrity of the wristband 520.

The lower portion 524 of the terminal portion 522 may include a laminating portion 5241, a first slot 5242, and a second slot 5243. The lower portion 524 is folded towards the upper portion 523 along the perforation line 525, and specifically towards the indicia on the print area 5231, to laminate the print area 5231. When so folded, the slot 5243 corresponds generally to the slot 5234, and slot 5242 corresponds generally to slot 5233. However, as discussed herein, the slot 5242 is larger than slot 5233, and therefore, the slot 5242 may encompass the slot 5233 upon folding.

Further, as can be appreciated, when folded, the laminating portion 5241 does not fully cover the print area 5231. Instead, the laminating portion 5241 covers only a part 5231*b* of the print area 5231, leaving another inboard part 5231*a* of the print area 5231 exposed. As a result, medical professionals may directly write or mark on the exposed part 5231*a* of the print area 5231 after the print area portion 5231*b* of the wristband 520 has been laminated. Further, less material is used and the wristband 520 is therefore more flexible since the two-layer area of the wristband 520 after lamination is smaller than that of a wristband where the lamination portion fully covers the printable portion.

The slot 5242 may be bigger than each of slot 5232, slot 5233, slot 5234, and slot 5243. Consequently, less material is used in the bottom portion 524, and the wristband 520 may be more flexible since the two-layer portion of the wristband 520 is smaller than that had the slot 5242 been identical to, and exactly matched, the slot 5233. Moreover, as described below, adhesive is provided on the back side of the bottom portion 524. Since slot 5242 is larger than slot 5233, when the bottom portion 524 is folded about the perforation line 525, the adhesive is fully concealed. Importantly, the strength of the wristband 520 may be properly maintained by providing the biggest slot 5242 in the laminating lower portion 524, rather than in the upper portion 523. If the slot 5233 in the upper portion 523 were sized to match the size of the slot 5242 in the lower portion laminating 524, the structural integrity of the wristband 520 may be compromised such that it may not function as desired.

The slot 5243 may (but need not) have a size identical to slot 5232 and slot 5234. The lower portion 524 may have a configuration similar to that of the upper portion 523 where the inboard slot 5242 may be larger than the outboard slot 5243, thus making the end piece of the wristband 520 more flexible since the whole end piece of the wristband 520 outboard of the bigger slot 5242 becomes more flexible. As discussed above, it has been found that enlarging the outboard slot 5243 in addition to or instead of the inboard slot 5242 unduly impacts the structural integrity of the wristband 520.

When a user dissociates the wristband 520 from the plastic back sheet 540 along the die cuts, the plastic portions inside the slots 5232, 5233, 5234, 5242, and 5243 stay with the plastic back sheet 540 and the slots are formed accordingly.

In addition to the wrist band 520, an extension portion 530 may be die-cut into the top portion 542 to allow the wristband 520 to accommodate larger wrists. The extension portion 530 may be defined by an arm portion 531 extending laterally from a central portion 532 having an upper portion 533 and a lower portion 534 separated by a perforation line 535. The arm portion 531 may include tamper evident slits 5311 configured to tear should the extension portion 530 be tampered with after the extension portion 530 is applied to the wearer. The upper portion 533 may match the lower portion 534 when they are folded along the perforation line 535.

In addition to the wristband 520 and the extension portion 530, a security seal 550 may be die-cut into the top portion 542. The security seal 550 may be used to secure the wristband 520 and/or the extension portion 530.

As show in FIG. 13, the wristband 520 may have a pattern of printed ink. The printed ink may be white or any other color, and may be opaque or translucent. The uncolored lines between the patterned area may be completely or partially transparent.

Figure 14:
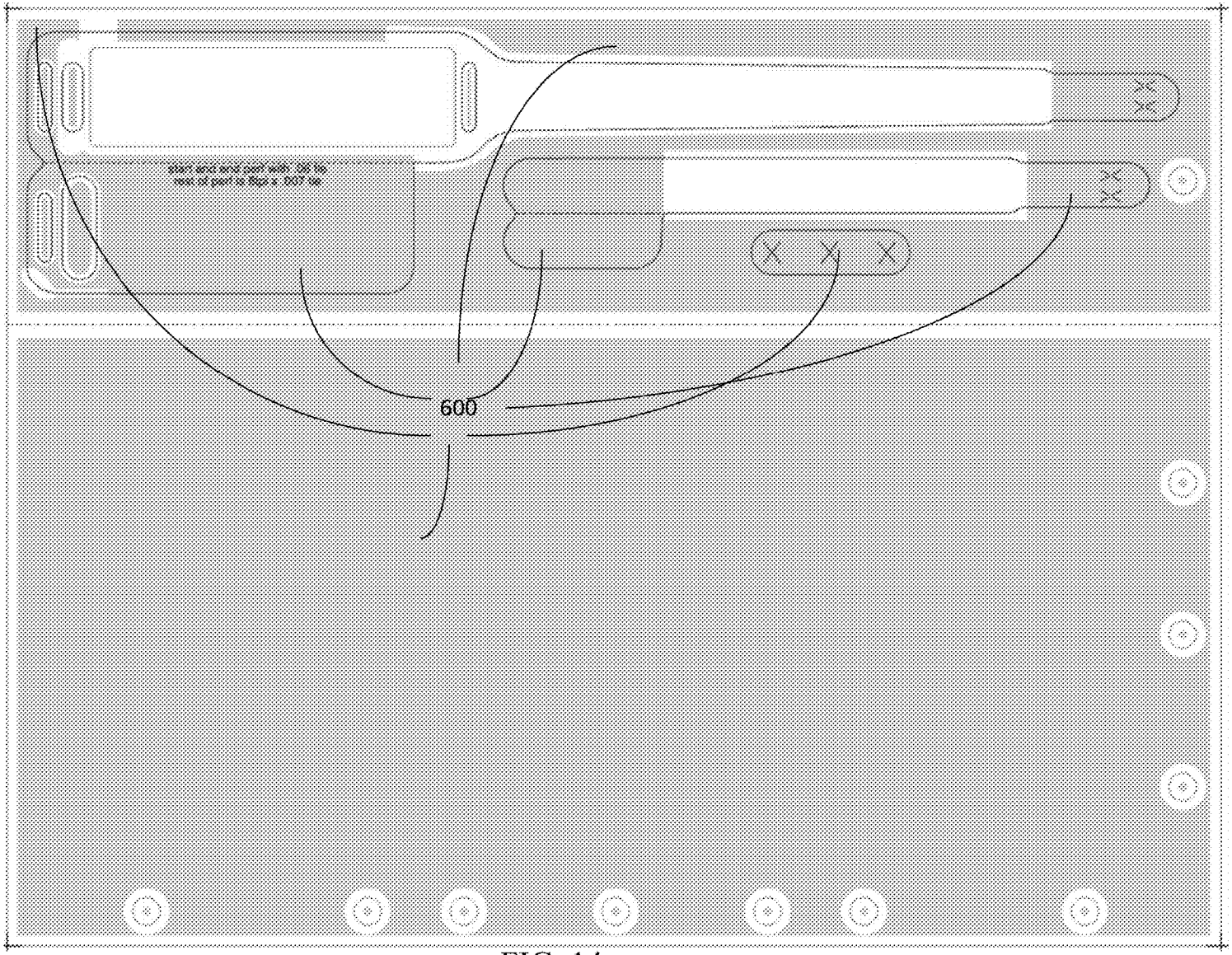
FIG. 14 shows an adhesive pattern between a back side of the front sheet and a back side of the back sheet of the wristband and label form shown in FIGS. 12 and 13.
Figure 15:
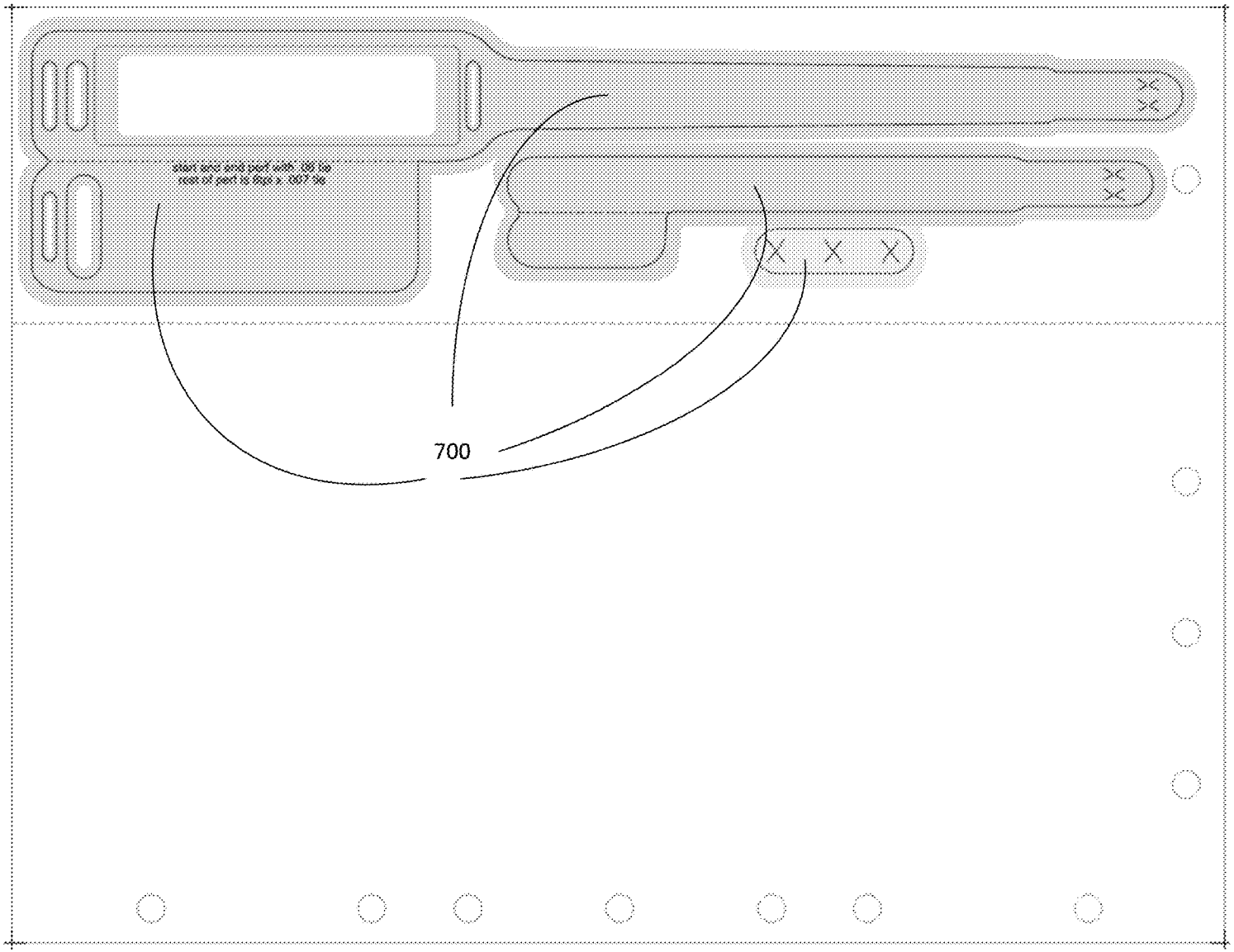
FIG. 15 shows a release material pattern between the back side of the front sheet and the back side of the back sheet of the wristband and label form shown in FIGS. 12 and 13.

FIGS. 14-15 disclose an adhesive pattern 600 and a release material (e.g., silicone) pattern 700, respectively, of the wristband and label form 500 according to embodiments of the disclosure. Both the adhesive 600 and the release material 700 are placed between the back side of the front sheet 501 and the back side of the back sheet 540. In some embodiments, the adhesive 600 and the silicone release material 700 are in contact with each other. Collectively, the adhesive 600 and silicone 700 allow the wristband 520 to be selectively secured to back face of the paper front sheet 501 such that the wristband 520 can be easily pulled away from the paper front sheet 501 when the wristband 520 is pulled out of the plastic back sheet 540 along the die cuts.

In some embodiments, after the print area 5231 has been printed, a user may secure the wristband 520 to the wrist by pulling the strap 520 off the wristband and label form 500, folding the laminating portion 5241 over a portion of the print area 5231 along the perforated line 525, and passing the tip of the strap 521 through a slot such that the strap 521 encircles the wrist of the user. The end of the strap 521 may include adhesive and may be secured to itself or to the terminal portion 522 to secure the wristband 520 to the wrist of a user. The tip of the strap 521 may desirably be passed through any of the slots 5232, 5234/5243, or 5233/5242. As described above, the reduction in material associated with the larger slot 5242 (and to a lesser degree, reduction in material associated with slot 5233) allows the portion of the wristband outboard (i.e., to the left in FIG. 13) of the large slot 5242 to desirably bend with the wrist of the user. If the slots 5233 and 5242 were instead smaller, the area outboard the slots 5242 and 5233 may not conform to the wrist but may instead lay flat. The flat area may be uncomfortable and may dig into the wrist of the user. Increasing flexibility of the wristband 520 as described herein may thus increase wearer comfort. The slot 5242 is bigger than the slot 5233 because if the slot 5233 were as big as the slot 5242, the wristband 520 may become structurally unsound and the entire strap 521 may pass through the enlarged slots 5242/5233. By ensuring that slot 5242 is bigger than the other slots (and specifically, by ensuring that slot 5233 is not as large as the slot 5242), wearer comfort is increased without appreciably degrading structural integrity and workability of the closing mechanism.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention. For example, the indicia-receiving area 405 illustrated on the top panel of the wristband may instead be provided on the bottom panel thereof. Or for instance, the form may comprise only one or more wristbands (e.g., one or more laminable single-ply wristbands) without any labels.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

The disclosure claimed is:

1. A patient-identification wristband, comprising:

a solitary strap;

a terminal portion having an upper section and a lower lamination section; said upper section comprising a printable ink defining a print area, a first slot inboard said print area and between said print area and said strap, a second slot outboard said print area, and a third slot outboard said second slot; said lower lamination section having a fourth slot below said second slot and a fifth slot outboard said fourth slot; a size of said fourth slot being bigger than a size of said first slot, said second slot, said third slot, and said fifth slot; a length of said upper section being greater than a length of said lower lamination section such that when said lower lamination section is folded over for lamination, said lower lamination section covers only a first part of said print area and leaves a second part of said print area exposed.

2. The patient-identification wristband of claim 1, wherein said patient-identification wristband is releasably coupled to a form, said form having a cutout such that said print area is printable through said cutout while said patient-identification wristband is releasably coupled to said form.

3. The patient-identification wristband of claim 2, wherein said print area is inset from said cutout.

4. The patient-identification wristband of claim 1, wherein said printable ink is opaque.

5. The patient-identification wristband of claim 1, wherein a size of said second slot is bigger than a size of that first slot, said third slot, and said fifth slot.

6. The patient-identification wristband of claim 1, wherein said solitary strap is devoid of adhesive except at an end of said strap.

7. The patient-identification wristband of claim 1, wherein said wristband comprises plastic.

8. The patient-identification wristband of claim 1, wherein said lower lamination section laminates more than half of said print area.

9. A patient-identification wristband, comprising:

a solitary strap;

a terminal portion having an upper section and a lower lamination section; said upper section comprising a printable ink defining a print area, a first slot outboard said print area, and a second slot outboard said first slot; said lower lamination section having a third slot below said first slot and a fourth slot outboard said third slot; a size of said third slot being bigger than a size of said first slot, said second slot, and said fourth slot; a length of said upper section being greater than a length of said lower lamination section such that when said lower lamination section is folded over for lamination, said lower lamination section covers only a first part of said print area and leaves a second part of said print area exposed.

10. The patient-identification wristband of claim 9, further comprising a fifth slot adjacent and inboard said print area.

11. The patient-identification wristband of claim 9, wherein said wristband is devoid of paper.

12. The patient-identification wristband of claim 9, wherein said patient-identification wristband is releasably coupled to a form, said form having a cutout such that said print area is printable through said cutout while said patient-identification wristband is releasably coupled to said form.

13. The patient-identification wristband of claim 12, wherein said print area is inset from said cutout.

14. The patient-identification wristband of claim 9, wherein said printable ink is opaque.

15. The patient-identification wristband of claim 9, wherein no slot in said wristband has a size bigger than said size of said third slot.

16. The patient-identification wristband of claim 9, wherein said solitary strap is devoid of adhesive except at an end of said strap.

17. The patient-identification wristband of claim 9, wherein said wristband comprises plastic.

18. The patient-identification wristband of claim 9, wherein said lower lamination section laminates more than half of said print area.

19. A patient-identification wristband, comprising:

a strap;

a terminal portion having an upper section and a lower lamination section; said upper section comprising a printable ink defining a print area, a first slot inboard said print area and between said print area and said strap, a second slot outboard said print area, and a third slot outboard said second slot; said lower lamination section having a fourth slot below said second slot and a fifth slot outboard said fourth slot; a size of said fourth slot being bigger than a size of said first slot; a length of said upper section being greater than a length of said lower lamination section such that when said lower lamination section is folded over for lamination, said lower lamination section covers only a first part of said print area and leaves a second part of said print area exposed.

* * * * *